US005454651A

United States Patent [19]

Tateyama

[11] Patent Number: 5,454,651

[45] Date of Patent: Oct. 3, 1995

[54] PRINTER CONTROLLER WITH ADDRESSABLE BUFFER MEMORY

[75] Inventor: Jiro Tateyama, Yokohama, Japan

[73] Assignee: Canon Kabushiki Kaisha, Tokyo, Japan

[21] Appl. No.: 82,156

[22] Filed: Jun. 28, 1993

Related U.S. Application Data

[63] Continuation of Ser. No. 739,327, Aug. 1, 1991, abandoned.

[30] Foreign Application Priority Data

Aug. 2, 1990 [JP] Japan ..... 2-205859

[51] Int. Cl.[6] ..... B41J 19/14

[52] U.S. Cl. ..... 400/323; 400/279

[58] Field of Search ..... 400/279, 320, 400/322

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,674,895 | 6/1987 | Tanaka | 400/323 |
| 4,706,008 | 11/1987 | Cronch | 400/903 |
| 4,723,129 | 2/1988 | Endo et al. | 346/1.1 |
| 4,740,796 | 4/1988 | Endo et al. | 346/1.1 |
| 4,777,609 | 10/1988 | Cavill et al. | 400/322 |
| 4,877,343 | 10/1989 | Hori | 400/121 |

FOREIGN PATENT DOCUMENTS

| | | | |
|---|---|---|---|
| 0263688 | 4/1988 | European Pat. Off. | 400/121 |
| 54-56847 | 5/1979 | Japan . | |
| 57-4952 | 1/1982 | Japan . | |
| 8666 | 1/1983 | Japan | 400/323 |
| 59-123670 | 7/1984 | Japan . | |
| 59-138461 | 8/1984 | Japan . | |
| 60-71260 | 4/1985 | Japan . | |
| 1-45424 | 10/1989 | Japan . | |

*Primary Examiner*—David A. Wiecking
*Assistant Examiner*—Steven S. Kelley
*Attorney, Agent, or Firm*—Fitzpatrick, Cella, Harper & Scinto

[57] ABSTRACT

A printer controller is for controlling a serial dot printer. The printer prints a dot picture on a paper by reciprocally scanning a recording head in horizontal forward and backward directions. The printer controller includes a buffer memory for storing print data in a dot pattern, a print starting address register for transferring the print data from the buffer memory to the recording head, a print end address register, an address counter, a print timing register for drive controlling the recording head, and a print timing pulse generator. The printer controller corrects vertical misregistration of print in the forward and backward printing by adjusting a set value of the print starting address of the print starting address register or a set value of the print timing register.

35 Claims, 22 Drawing Sheets

PRINTER CONTROLLER WITH ADDRESSABLE BUFFER MEMORY

This application is a continuation of application Ser. No. 07/739,327 filed Aug. 1, 1991, now abandoned.

BACKGROUND OF THE INVENTION

1. Field of the Invention

The present invention relates to a printer controller for dot matrix type serial printers having a text processing function and used for word processors, or the like. The printer controller is capable of correcting vertical misregistration of a print in the forward and backward printing.

2. Description of the Prior Art

Heretofore, serial printers having a movable unit (carriage) on which a recording head is mounted are proposed in a number of forms that mount various types of recording heads. The recording heads are adapted to make reciprocating movement perpendicularly to the feed direction of a recording medium such as paper, transparent films for over head projectors, or the like. For example, recording heads such as wire dot heads, thermal heads, thermal ink-transfer heads, ink jet recording heads are used in this type of serial printers, particularly for producing characters, figures and other pictures in a dot matrix.

To make a reduction in cost of word processors having such serial printers incorporated thereinto, all the operations, such as printing, text processing and the control of the floppy disk drives (FDD), are usually controlled by a single microprocessing unit (MPU). The reason is that this configuration reduces the total cost of the system although an excessive load is applied on the software. To attain high speed printing, since a software dependent system has a limit, a system has been proposed in which the print control unit partly uses gate arrays to perform operations at a relatively low cost by means of hardware. For example, the inventors proposed in Japanese Patent Application Nos. 1-344916 and 1-344917 (U.S. Ser. No. 635,870 filed on Dec. 28, 1990 in Art Unit 337), a technique that the print waiting time is minimized when the forward and backward printing is performed by using a line buffer for one line, in which data conversion of the next line is conducted during printing of the line.

Moreover, such as described in Japanese Patent Application Publication No. 57-4952, with a purpose to further reduce the useless motion of the carriage, the carriage is controlled to move only in an area in which print data is provided, and thereby the printer is enhanced in throughput.

In this kind of printer which performs forward and backward printing, there are required capabilities, such as forming tables using vertical and horizontal ruled lines, forming figures such as a graph, printing enlarged characters over lines, and hence it is desired to register vertical relative positions of prints in the forward and backward printing at a higher accuracy. To meet the requirement to improve resolution of print, dots which constitute print patterns becomes rather finer, and thus slight vertical misregistration of print positions in the forward and backward printing becomes conspicuous and provides poor appearance. Also from this point it is strongly desired to exactly adjust prints in the forward and backward printing.

To prevent vertical recording position misregistration in the forward and backward printing using an MPU, such as described in Japanese Patent Application Publication No. 1-45424, conventionally, fine adjustment is made on output timing of individual print data by software controlling.

According to the prior art, however, it is difficult to achieve high speed printing by hardware controlling since recording position misalignment is adjusted only by the MPU.

Even in the case where the effective speed of the carriage is sufficiently high, rather fine position control of the carriage by the MPU as previously described takes considerable time, and as a result, noticeable improvement in printing speed is not attained.

SUMMARY OF THE INVENTION

The object of the present invention is to provide a printer controller of a serial printer which is capable of correcting vertical recording misregistration in the forward and backward recording without deteriorating the recording speed.

For that purpose, a first aspect of the present invention provides a printer controller for a serial printer of which a recording head is scanned for recording in a forward and backward directions perpendicular to a feed direction of a recording medium, the recording head being adapted to produce a picture in a dot matrix, comprising:

an addressable buffer memory for storing print data;

transferring means for transferring the print data from the addressable buffer memory to the recording head according to an address outputted from an address counter;

drive control means for record and drive controlling the recording head;

a first register unit for setting a starting address into the address counter of the transferring means due to adjust a print start dot position in at least one of forward and backward printing; and a second register unit for setting into the drive control means an initial value due to adjust print start timing in at least one of the forward and backward printing.

A second aspect of the present invention provides a printer controller for a serial printer of which a recording head is scanned for recording in forward and backward directions perpendicular to a feed direction of a recording medium, the recording head being adapted to produce a picture in a dot matrix, comprising:

an addressable buffer memory for storing print data;

transferring means for transferring the print data from the addressable buffer memory to the recording head according to an address outputted from an address counter;

drive control means for record and drive controlling the recording head; and a register unit for setting a starting address into the address counter of the transferring means due to adjust a print start dot position in at least one of forward and backward printing.

A third aspect of the present invention provides a printer controller for a serial printer of which a recording head is scanned for recording in forward and backward directions perpendicular to a feed direction of a recording medium, the recording head being adapted to produce a picture in a dot matrix, comprising:

an addressable buffer memory for storing print data;

transferring means for transferring the print data from the addressable buffer memory to the recording head according to an address outputted from an address counter;

drive control means for record and drive controlling the recording head; and a register unit for setting into the drive control means an initial value due to adjust print start timing in at least one of the forward and backward printing.

With such construction above-mentioned, print start timing adjustment and data pointer adjustment with regard to a print start dot position are carried out by hardware controlling at least one of the forward and backward printing. This enables even a simple system with a single MPU for lower cost to correct vertical print misregistration in the forward and backward printing without deteriorating the printing speed.

The above and other objects, effects, features and advantages of the present invention will become more apparent from the following description of embodiments thereof taken in conjunction with the accompanying drawings.

BRIEF DESCRIPTION OF THE DRAWINGS

Embodiments of the invention will now be described, by way of example, and with reference to the accompanying drawings in which.

DETAILED DESCRIPTION OF PREFERRED EMBODIMENTS

Figure 1A:
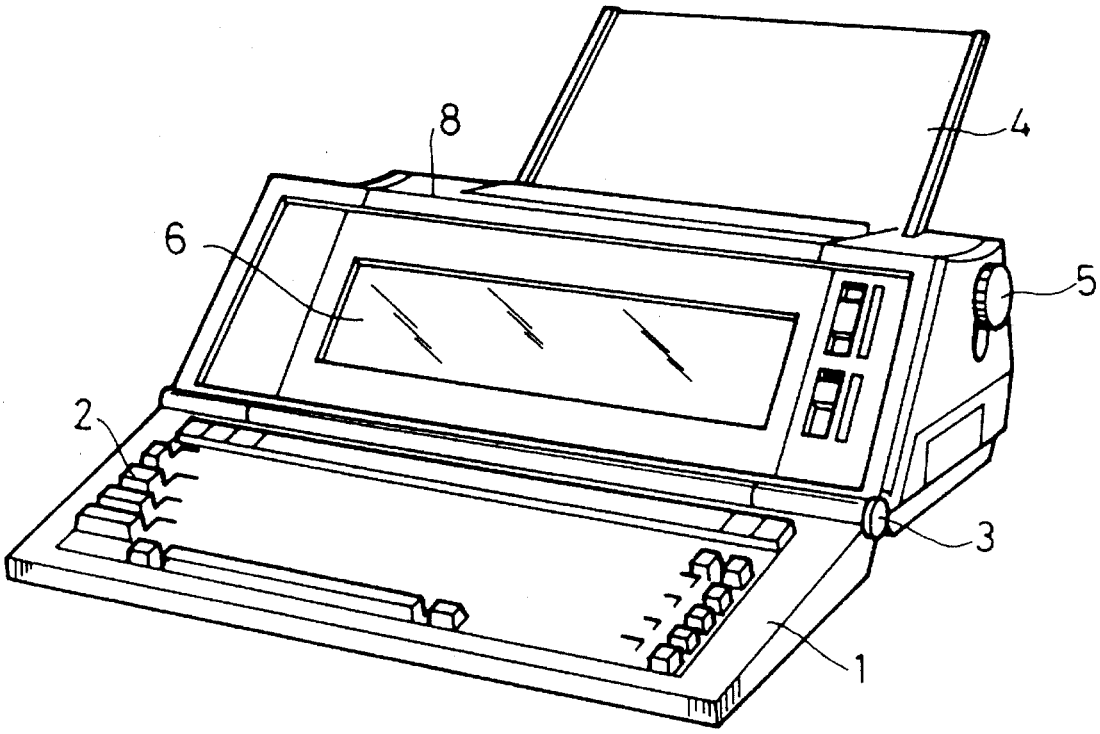
FIGS. 1A and 1B are perspective views showing an appearance when used and an appearance when closed, respectively, of an electronic printer to which the present invention is applied.

Throughout the following detailed description, similar reference numerals refer to similar elements in all figures of the drawings.

Figure 1B:
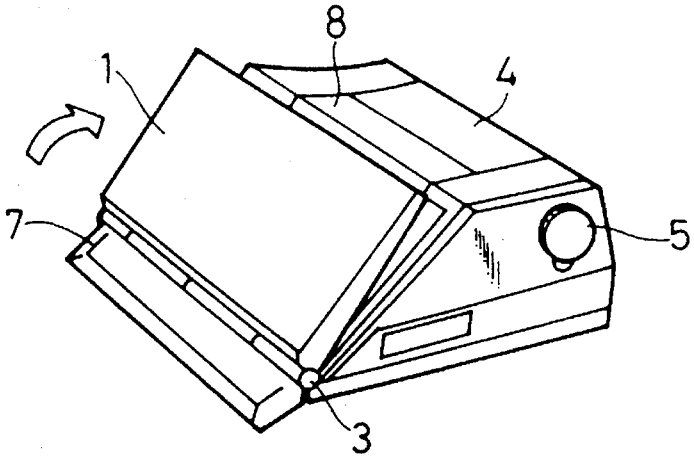

FIGS. 1A and 1B are external views of an electronic typewriter or word processor to which the present invention can be applied.

In these figures, reference numeral 1 denotes a keyboard on which are disposed keys 2 for entering characters, numerals, control signals or the like. The keyboard 1 can be folded as shown in FIG. 1B by turning it about a hinge 3 when the typewriter is unused. Reference numeral 4 denotes a feed tray for feeding a sheet-like recording medium to a print portion in the apparatus. The feed tray 4 can also be folded to cover the print portion as shown in FIG. 1B when the typewriter is unused. Reference numeral 5 denotes a feed knob for manually setting or feeding out the recording medium; 6, a display for showing entered sentences or the like; and 7, a handle for carrying the apparatus.

Reference numeral 8 denotes a window serving to function as a cover provided at the top of the electronic typewriter of the embodiment, adjoining the display 6. The window 8 is made of a transparent plastics or the like. The print portion and recording medium that are installed in the typewriter can be seen through the window 8.

Figure 2:
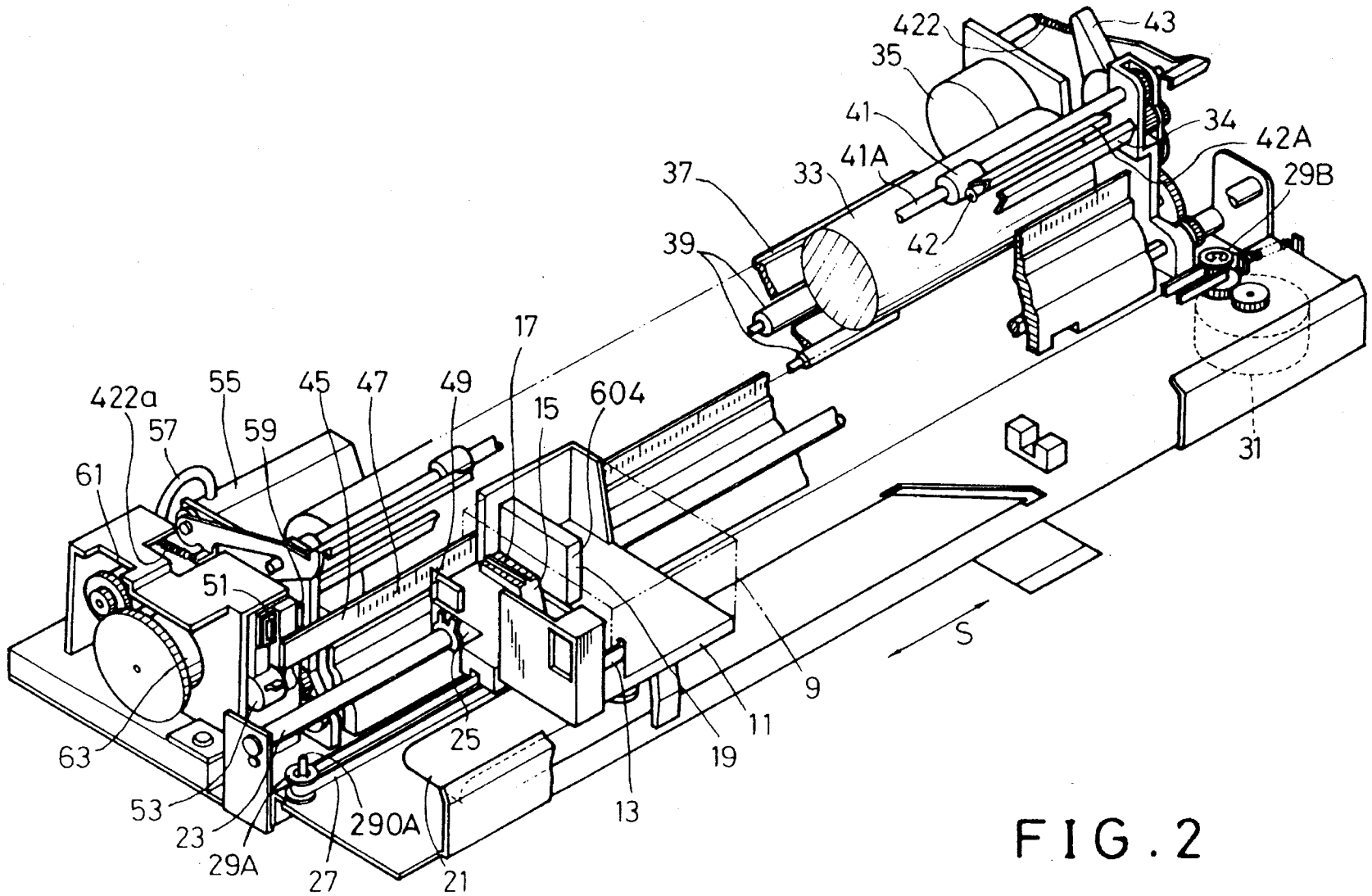
FIG. 2 is a perspective view showing an example of a printer to which the present invention can be applied.

FIG. 2 shows an example of the arrangement of the printer unit.

Reference numeral 9 denotes a head cartridge including an ink jet print head, which will be described in detail later with reference to FIGS. 3 and 4. Reference numeral 11 denotes a carriage on which the head cartridge 9 is mounted, and which scans in the direction S of FIG. 2. Reference numeral 13 denotes a hook for attaching the head cartridge 9 to the carriage 11, and 15, a lever for manipulating the hook 13. To the lever 15, is attached a marker 17 that denotes a scale provided on a cover which will be described later, thus making it possible to read the printing position or the setting position of the print head in the head cartridge 9. Reference numeral 19 denotes a support plate for supporting an electric connecting portion 604 to the head cartridge 9. The electric connecting portion 604 is connected to the control portion (recording head drive means) of the apparatus by a flexible cable 21.

The carriage 11 is guided in the direction S along a guide shaft 23 which is inserted through bearings 25 and 25' attached at either side of the carriage 11. The carriage 11 is attached to a timing belt 27. The timing belt 27 is stretched around two pulleys 29A and 29B which are provided at both sides of the apparatus, and transmits force to the carriage 11 to move it in the longitudinal directions S. The driving force is transmitted from a carriage motor 31 to the pulley 29B via a transmission mechanism such as gears.

Reference numeral 33 denotes a transport roller that is driven by a transport motor 35 to feed the recording medium such as paper, transparent films for over head projectors, or the like. The recording medium is guided by a paper pan 37 from the feed tray 4 to the printing position. When the recording medium is carried, it is pressed to the transport roller 33 by feed rollers 39 which are provided on the passage of the recording medium. In addition, its record surface is restricted by a platen 34 which is provided opposite the ejection-outlet-disposed surface of the head cartridge 9. In the passage of the recording medium, feed-out rollers 41 for feeding the recording medium into a feed-out aperture not shown are provided at positions that are located at a downstream portion of the paper feeding passage with regard to the printing position. Opposite each feed-out roller 41, a spur wheel 42 is provided to press the roller 41 to produce force for transporting the recording medium by the roller 41. The pressures of the feed rollers 39, a pressure plate 45, and the spur wheels 42 are released by a release lever 43.

The recording medium is pressed by a pressure plate 45 so as to closely fit on the transport roller 33, thus preventing the fluctuation of the recording medium in the vicinity of the printing position. In the embodiment, an ink jet recording head that records by ejecting ink is adopted as the recording head. This requires that the gap formed between the surface of the recording head on which ink ejection outlets are disposed and the recording surface of the recording medium be rather narrow and that the gap must be strictly controlled to prevent the contact between the two. The pressure plate 45 serves to prevent the contact. On the pressure plate 45, a scale 47 is formed which is indicated by a marker 49 provided on the carriage 11. This makes it possible to read from the scale 47 the printing position or the setting position of the recording head.

At the home position of the recording head, the ink ejection-outlet-disposed surface of the recording head faces a cap 51 which is made of an elastic material such as rubber. The cap 51 is supported in such a manner that it is touchable to and separable from the recording head so that the cap 51 can protect the recording head when it is unused, or is used for ejection recovery operation of the recording head. The ejection recovery operation means the following:

removing processing of impeding factors of the ejection by preliminary ejection; the cap 51 is faced with the ejection-outlet-disposed surface of the recording head, and an energy generating device for ejecting the ink is provided inwardly of the ink ejection outlets and driven so that the ink is ejected from all the ejection outlets; and/or forced ink discharge from the ejection outlets; it is carried out with the cap 51 covering the ejection-outlet-disposed surface so that the ejection impeding factors such as bubbles or dust which mixes with ink, or ink which becomes unsuitable for ejection because of increase in viscosity can be removed.

The suction pressure for the forced discharge is produced by a pump 53: the pump 53 is driven to suck the ink received by the cap 51 during the ejection recovery operation which is performed in the form of forced discharge or preliminary ejection. The waste ink thus sucked by the pump 53 is stored in a waste ink reservoir 55 which is communicated with the pump 53 through a tube 57.

The ejection-outlet-disposed surface of the recording head can be wiped by a blade 59 which is slidably supported between a wiping position and a recessed position: at the wiping position, the blade 59 is projected until it is in a position to touch the ejection-outlet-disposed surface so that the head can be wiped in the course of moving; and at the recessed position, the blade 59 is pulled so that it does not touch the ejection-outlet-disposed surface. The pump 53 is driven by a motor 61 through a cam device 63. The motor 53 also drives the cap 51 and blade 59 through the cam device 63.

Next, the head cartridge 9 will be described in detail.

Figure 3:
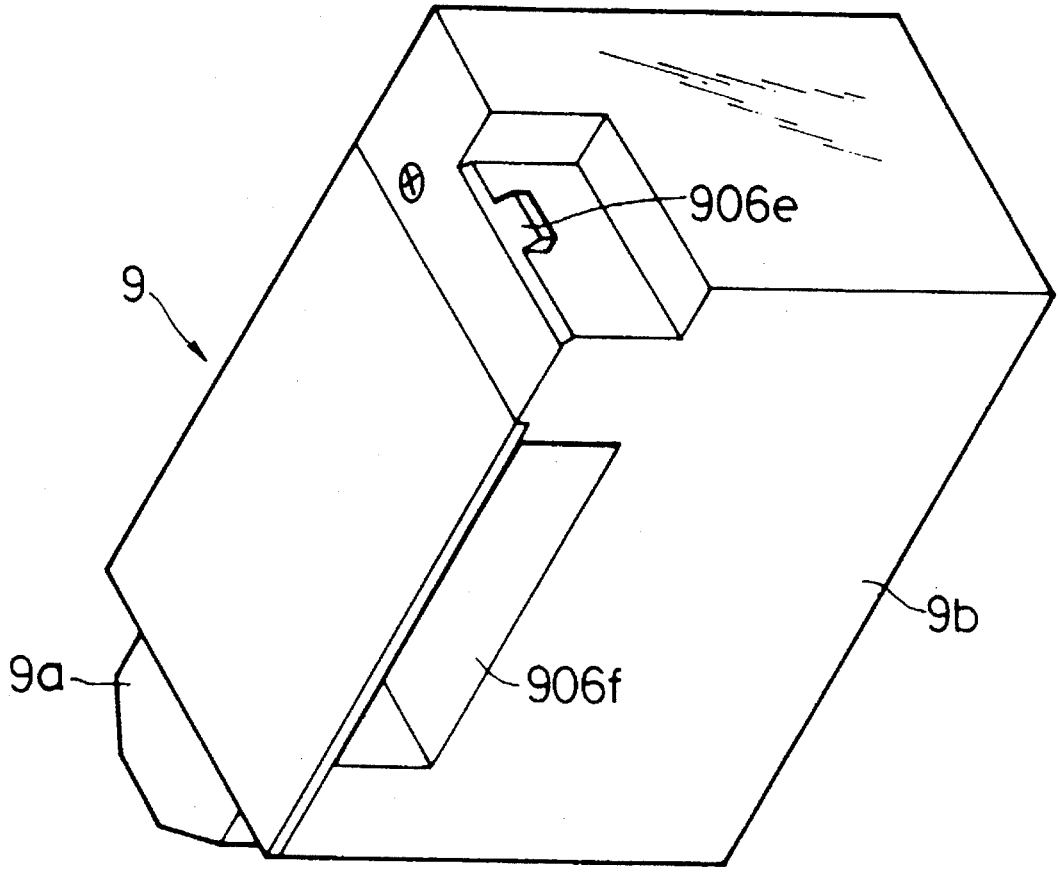
FIG. 3 is a perspective view showing an appearance of the head cartridge 9 shown in FIG. 2.

FIG. 3 is a perspective illustration showing the appearance of the cartridge 9, a unit including a ejection unit **9*a* and an ink reservoir 9*b* which constitute the main portion of the ink jet recording head. The cartridge 9 is installed on the carriage of the printer unit 11 with the hook 13 catching a hook 906*e* provided on the cartridge 9. As clearly seen from FIG. 3, the hook 906*e* is disposed on the back of the cartridge 9. In the vicinity of the ejection unit 9*a* installed at the front of the head cartridge 9, a cartridge stop (not shown) for adjusting the position of the cartridge 9 is provided. The cartridge 9 is further provided with a recess 906*f* which is a head opening portion into which the support plate is inserted. The support plate supports a flexible printed board as the electric connecting portion of the flexible cable and a rubber pad (see FIG. 5**A).

Figure 4A:
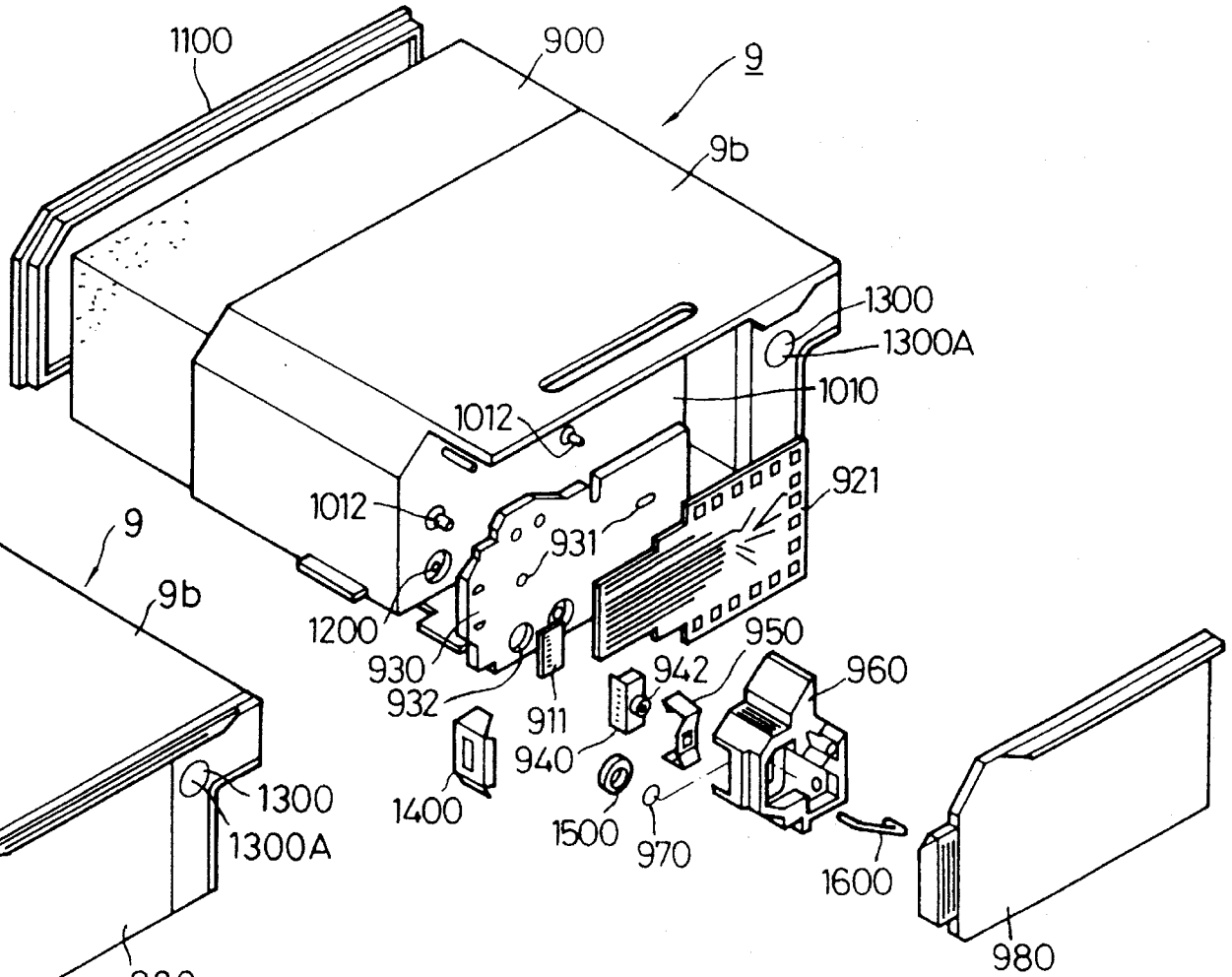
FIG. 4A is an exploded perspective view showing the arrangement of the head cartridge 9 shown in FIG. 3.
Figure 4B:
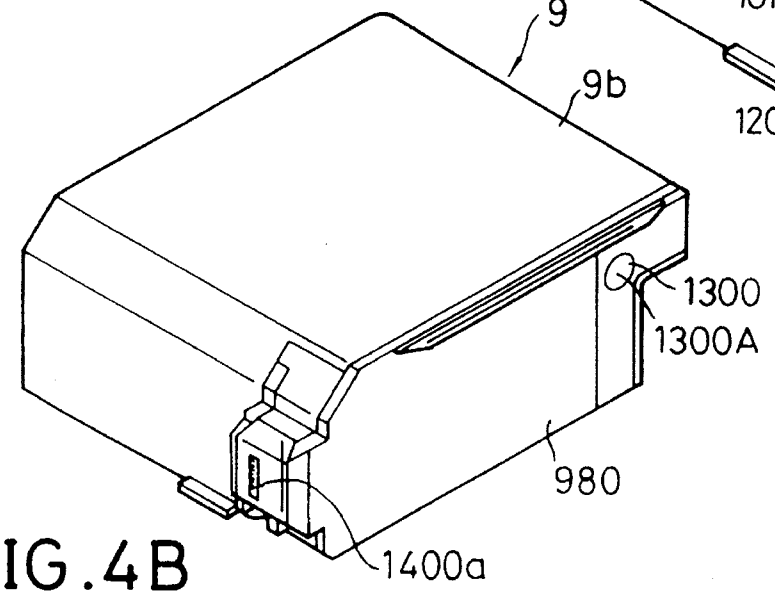
FIG. 4B is a perspective view showing an appearance of the head cartridge 9.

FIGS. 4A and 4B are exploded views of the head cartridge shown in FIG. 3. The head cartridge is of a disposable type and has the ink reservoir or the ink source as its integral part as mentioned before.

In FIG. 4A, reference numeral 911 denotes a heater board having an electrothermal transducer (an ejection heater) that generates thermal energy used for ejecting the ink, and wiring patterns of aluminum or the like for supplying power to the ejection heater. The ejection heater and the wiring patterns are formed on an Si substrate by a film technique. The heater board 911 is joined to a wiring board 921 with the corresponding wires being connected by wire bonding.

Reference numeral 940 denotes a top plate on which separation walls for defining ink passages, and a common ink chamber are formed. In this example, the top plate is made of a resin material on which a member having the ejection-outlet-disposed surface is integrally formed.

The heater board 911 and the top plate 940 are pressure fastened to a supporting plate 930 made of metal, for example: the heater board 911 and the top plate 940 are coupled and put between the supporting plate 930 and a pressure bar flat spring 950, and are fastened by the pressure of the spring 950. The supporting plate 930 has the following functions: first, it supports the printed board 921 attached thereto by adhesion or the like; second, it can be provided with a positional reference for loading the head cartridge 9 to the carriage 11 for head scanning; and third, it functions as a heat dissipating member for radiating heat produced by the drive of the heater board 911.

A supply reservoir 960, being supplied with ink from the ink reservoir **9*b* which is the ink source, guides the ink into the common ink chamber formed by joining the heater board 911 and the top plate 940, thus functioning as a subreservoir. The supply reservoir 960 includes a filter 970 near the ink inlet of the common ink chamber, and has a lid member 980**.

An absorber 900 is disposed in the ink reservoir **9*b* to be impregnated with the ink. The above elements 911–980** constitute the ejection unit 9*a* to which the ink is supplied through a feed aperture 1200. The absorber 900 can be impregnated with ink injected through the feed aperture 1200 before the ejection unit 9*a* is attached to a portion 1010 of the ink reservoir 9*b*.

On one side of the cartridge 9, a lid member 1100 is provided. On the other side of the cartridge 9, a vent 1300 as an inlet for serving air is provided. Inside the vent 1300, an ink repellent member 1300A is disposed, thus preventing the waste ink from leaking out of the vent 1300. Reference numeral 1400 denotes a front plate for protecting the ejection-outlet-disposed surface.

When filling of the ink reservoir 9*b* with ink through the feed aperture 1200 has been completed, the ejection unit 9*a* which is constituted by the elements 911–980 is positioned and fastened to the portion 1010. The positioning can be carried out by fitting protrusions 1012 on the ink reservoir 9*b* into corresponding holes 931 provided on the supporting plate 930. Thus, the head cartridge 9 as shown in FIG. 3 is obtained.

The ink is fed from the ink reservoir 9*b* to the supply reservoir 960 through the feed aperture 1200, a hole 932 in the supporting plate 930, and an inlet of the supply reservoir 960. After passing the inside of the supply reservoir 960, the ink pours into the common chamber through the outlet of the supply reservoir 960, a feed tube, and an ink inlet 942 of the top plate 940. At the joint portions of the ink passage, packings made of silicone rubber or butyl rubber are disposed so that the ink passages are tightly sealed.

Figure 5A:
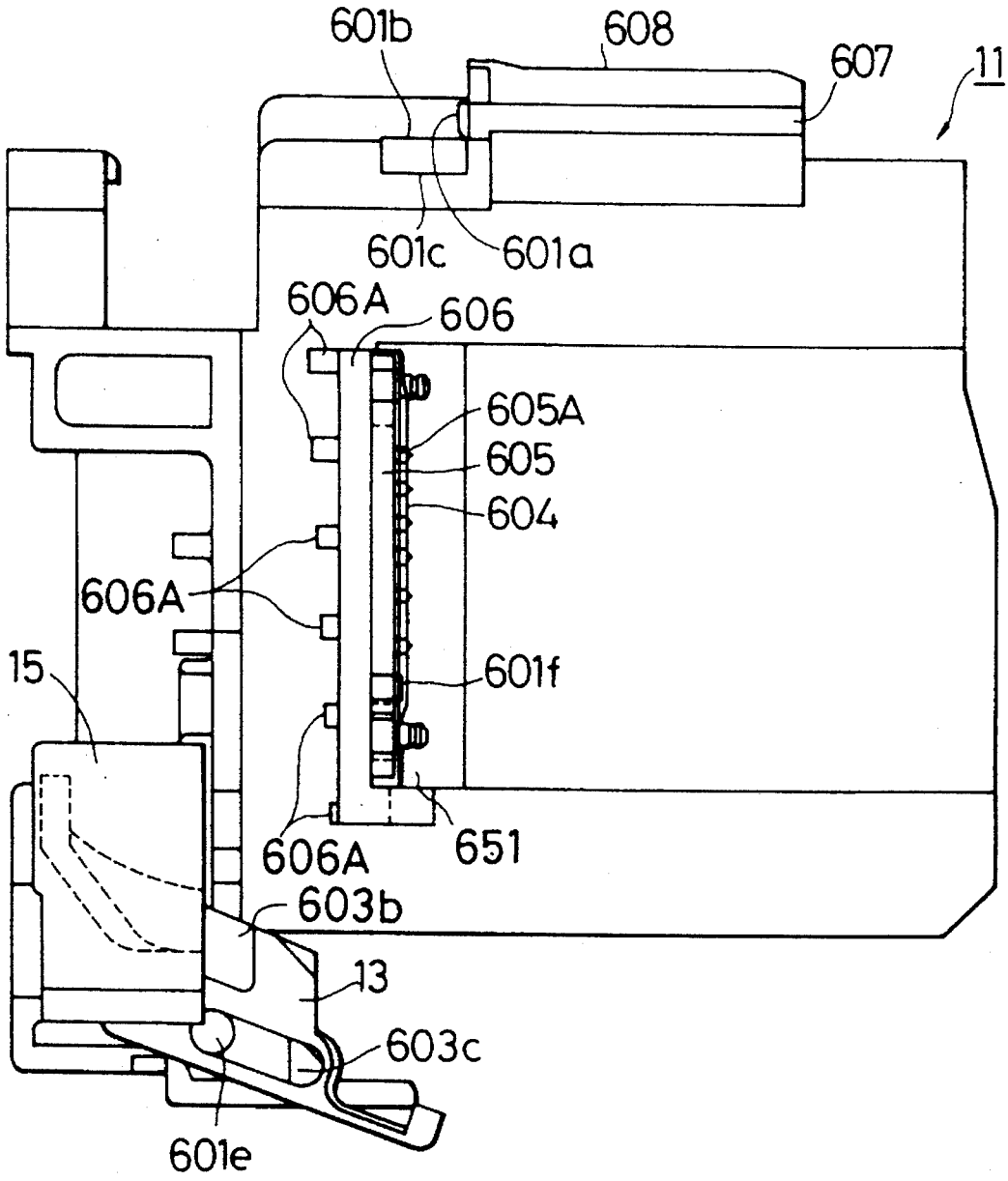
FIGS. 5A and 5B are a plan view and a side view showing an arrangement of the carriage 11 shown in FIG. 2, respectively.
Figure 5B:
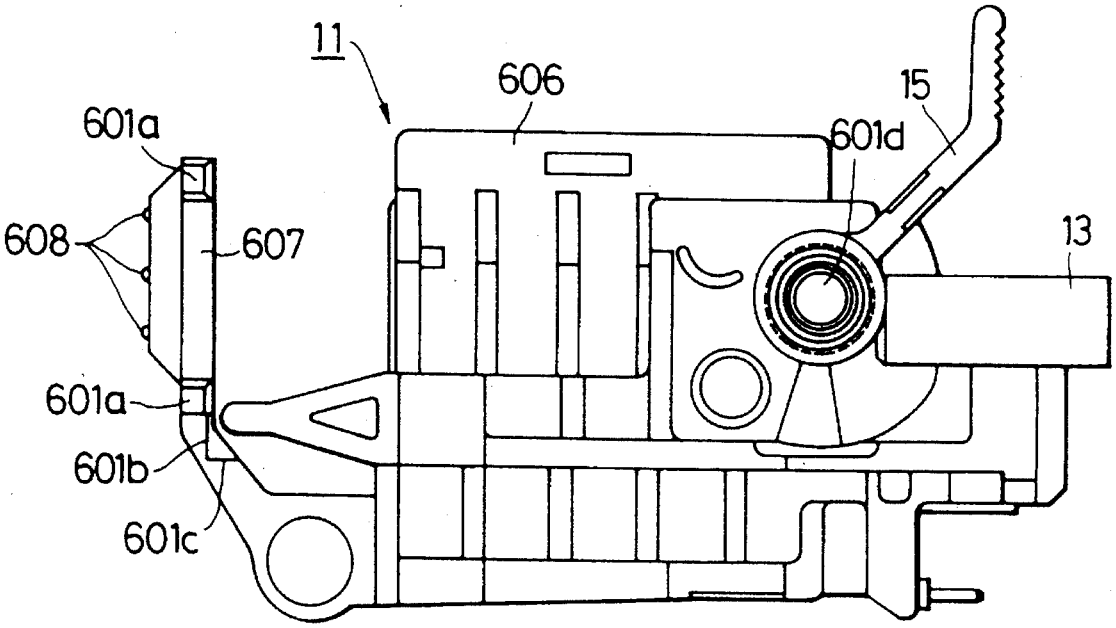

FIGS. 5A and 5B are plan views, and a left side view of the carriage 11, respectively.

In these figures, a supporting plate 606 is set upright on the bottom of the carriage 11. The supporting plate 606 supports a rubber pad 605, and a flexible printed board 604 placed on the rubber pad 605. The rubber pad 605 has protrusions 605A corresponding to terminal pads formed on the printed board 604.

At the front of the carriage 11, a stop member 607 for positioning the head cartridge 9 is set upright on the bottom of the carriage. The stop member 607 is made thin so that the space for the ink reservoir 9*b* is made as large as possible in a limited range by the head cartridge 9 and the carriage 11. For this reason, the stop member 607 is strengthened by three ribs 608 which extend in the direction of the movement of the carriage 11. The direction corresponds to the turning direction of the head cartridge 9 when it is attached to or removed from the carriage 11. The ribs 608 are formed in such a manner that the ribs 608 protrude forwardly from the ejection-outlet-disposed surface 1400*a* by about 0.1 mm when the head cartridge 9 is attached to the carriage 11. This prevents the ejection-outlet-disposed surface from being scratched by record paper even if the record paper curves into the passage of the recording head by some reasons.

The operation lever 15 used for manually installing and removing the head cartridge 9 is rotatably supported about an axis 601*d* provided on the carriage 11. The hook 13, which moves with the operation lever 15, catches the hook 906*e* on the head cartridge 9 so that head cartridge 9 is installed on the carriage 11: the hook 13 has a slot 603*c* into which a guide shaft 601*c* provided on the carriage 11 is inserted so that the hook 13 is guided along the slot 603*c* in the installation and removal of the head cartridge 9.

The installation and removal manipulation mechanism composed of the operation lever 15, hook 13 and the like is provided not at the front or rear but at a side of the carriage 11, or in the moving direction of the carriage 11. This prevents the dead space that would be caused by the manipulating mechanism which is provided at the front or rear of the carriage 11 when the carriage 11 moves.

Next, stop portions for positioning the head cartridge 9 are explained.

Stop portions 601*a* are provided at two locations on the side of the stop member 607 for adjusting longitudinal position (right-to-left or left-to-right position in FIG. 5B) of the head cartridge 9. The longitudinal position of the head cartridge 9 is also restricted by a stop portion 601*f* provided on the supporting plate 606 other than the stop portions 601*a*.

A stop portion 601*b* is formed at a side bottom of the stop member 607 for adjusting the lateral position (top-to-bottom or bottom-to-top position in FIG. 5B) of the head cartridge 9.

Stop portions 601*c* are formed on two locations, that is, at a side bottom of the stop member 607 and a side bottom of the supporting plate 606 for adjusting the top-to-bottom position of the head cartridge 9.

Figure 6A:
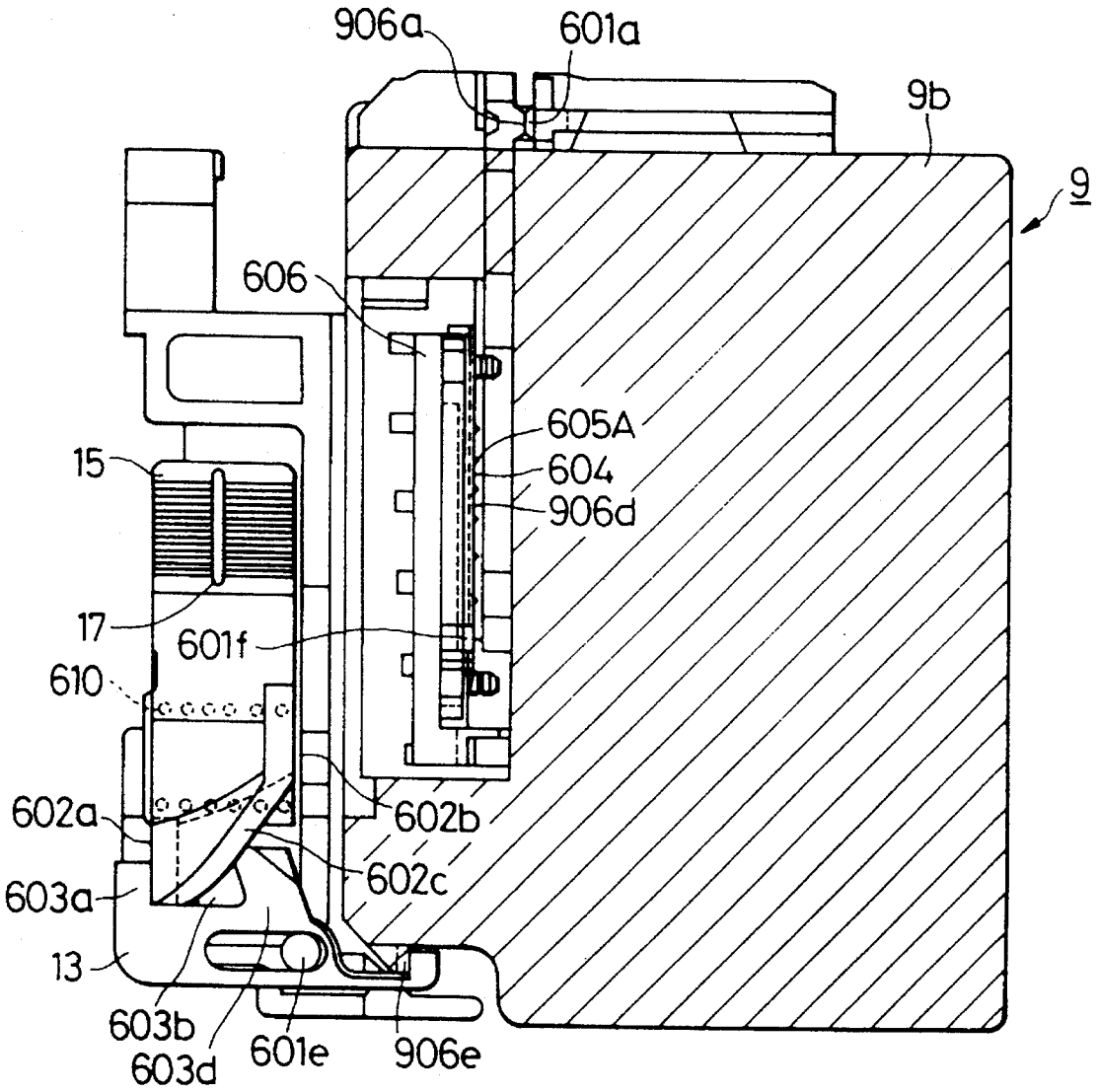
FIGS. 6A and 6B are a plan view and a side view showing the state when the head cartridge 9 is mounted on the carriage 11, respectively.
Figure 6B:
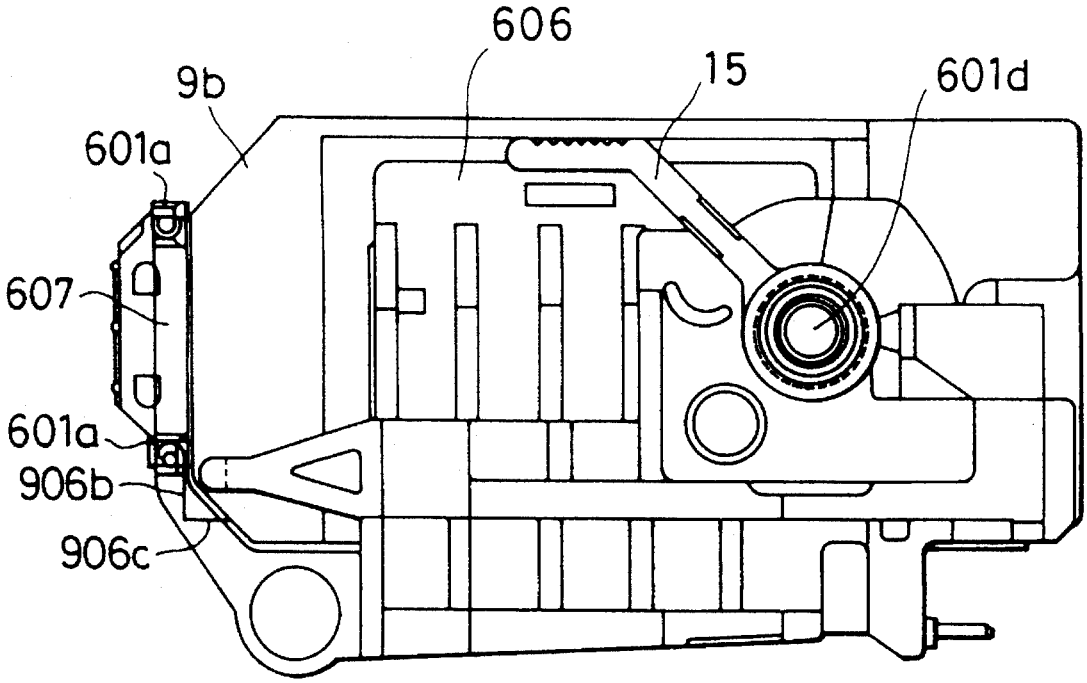

FIGS. 6A and 6B are a plan view and a left side view showing the appearance when the head cartridge 9 is installed to the carriage 11, respectively.

In these figures, contact portions 906*a* are provided on the head cartridge 9 so that they can make contact with the stop portions 601*a* of the carriage 11 when the head cartridge 9 is installed to the carriage 11. Likewise, contact portions 906*b* and 906*c* are provided on the head cartridge 9 to make contact with the stop portions 601*b* and 601*c* of the carriage 11.

First, the relationship of various portions when the cartridge 9 is loaded on the carriage 11 will be described with reference to FIG. 6A.

The contact portions 906*a* of the head cartridge 9 make contact with the stop portions 601*a* of the carrier 6. At the same time, the hook 906*e* on the head cartridge 9 is pressed to the left of FIG. 6A by a helical spring 610 via the hook 13. Thus, the head cartridge 9 is subjected to the moment of force, the axis of which is the contact portions 906*a*, and a printed board 906*d* provided in the head cartridge 9 makes contact with the stop portion 601*f*. As a result, the longitudinal position (right-to-left or left-to-right position) in FIG. 6A of the head cartridge 9 is determined, and the cartridge 9 is maintained at that position.

The protrusions 605A of the rubber pad 605 make contact with the printed board 906*d*, thereby to be compressed and deformed. The deformity exerts pressure on the flexible printed board 604 so that the terminal pads of the flexible printed board 604 and the terminals of the printed board 906*d* make contact. In this case, since the printed board 906*d* makes contact with the stop portion 601*f*, the deformity of the protrusions 605A is restricted by the stop portion 601*f*, which makes the pressure nearly constant. Incidentally, the deformity of the protrusions 605A is not depicted in FIG. 6A. The lateral and vertical positioning of the head cartridge 9 is performed during the installation of the cartridge.

Figure 7:
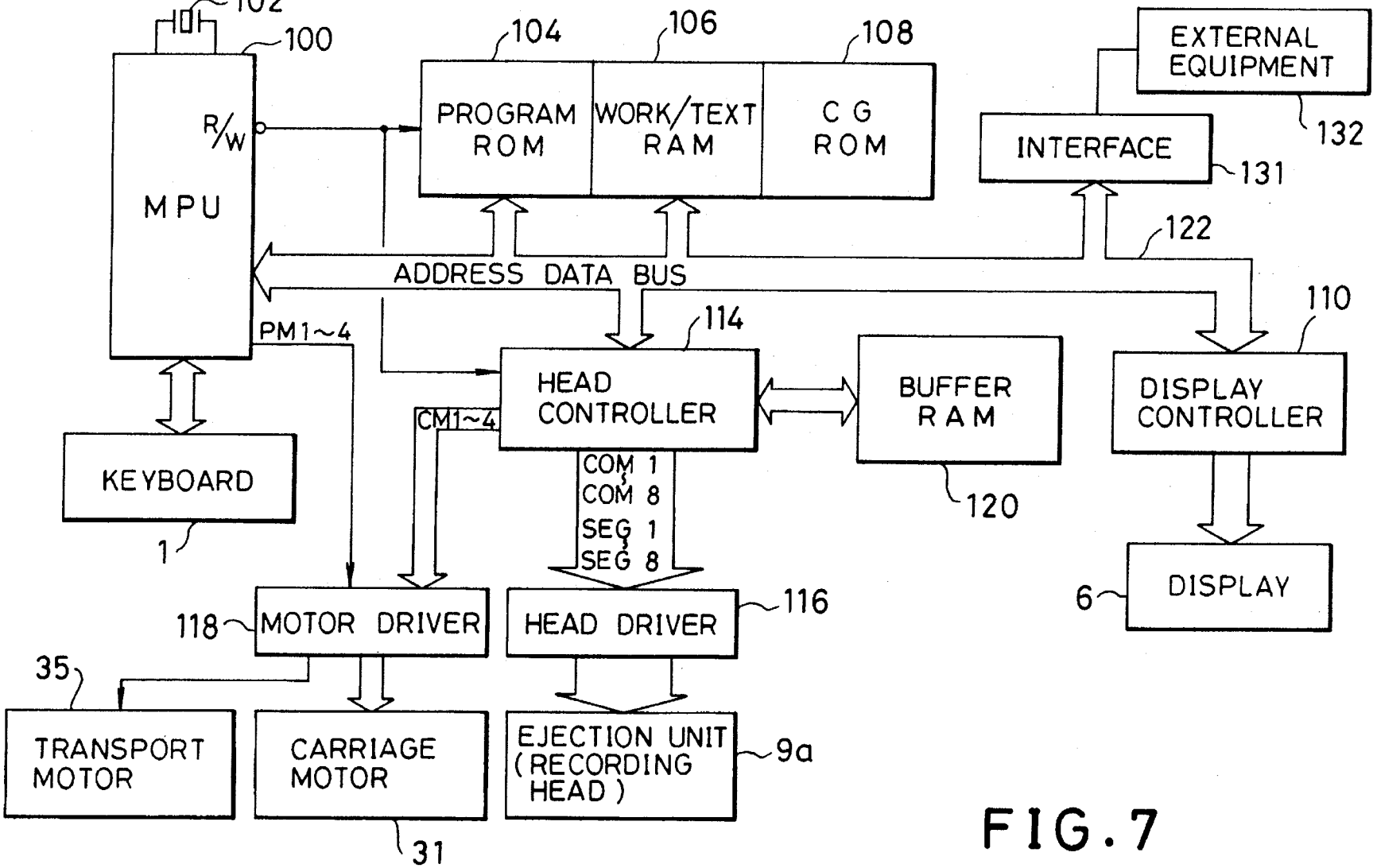
FIG. 7 is a block diagram showing a configuration of the overall control system of a word processing unit of one embodiment of the present invention.

FIG. 7 shows a configuration of a control system of a word processing unit of one embodiment of the present invention. In FIG. 7, reference numeral 100 denotes a micro processing unit (MPU) which constitutes the main control unit of the system. The MPU 100 executes predetermined control operations according to data and control signals inputted from the keyboard 1. The reference numerals 102, 104, 106, 108 and 110 denote a crystal oscillator, a read only memory (ROM), a random access memory (RAM), another ROM, and a display controller, respectively. The crystal oscillator 102 generates basic clocks to set operation timing or the like of each part of the system. The ROM 104 stores programs which correspond to record control procedure shown in FIGS. 16 and 17 which are to be executed by the MPU 100. The program ROM 104 also stores fixed data or like data. The RAM 106 is used for a register or the like and has storage areas for work data and development areas for documents (texts) or the like. The ROM 108 is used as a character generator (CG). The display controller 110 is made to indicate data by the display 6, for example a liquid crystal display (LCD).

The reference numeral 114 denotes a head controller which will be described in detail hereinafter with reference to FIGS. 12A and 12B. The head controller 114 generates control signals COM1 to COM8 and SEG1 to SEG8 for a head driver 116 to drive an ejection energy generation element group of the ejection unit (record head) 9*a*. The reference numeral 118 denotes a motor driver which drives the carriage motor 31 and the transport motor 35. Drive control signals CM1 to CM4 for the carriage motor 31 are supplied from the head controller 114 to the motor driver 118, and drive control signals PM1 to PM4 for the transport motor 35 are fed from the MPU 100 to the motor driver 118.

The reference numerals 120 and 122 denotes a RAM and an address data bus interconnecting the parts 104, 106, 108, 110 and 114, respectively, The RAM 120 is used as a buffer to store, for example, a line of received data for recording and the processing of such data which is used for recording. The reference character R/W denotes a control signal to switch read/write state of each of the parts 104–108 and 114.

Figure 8:
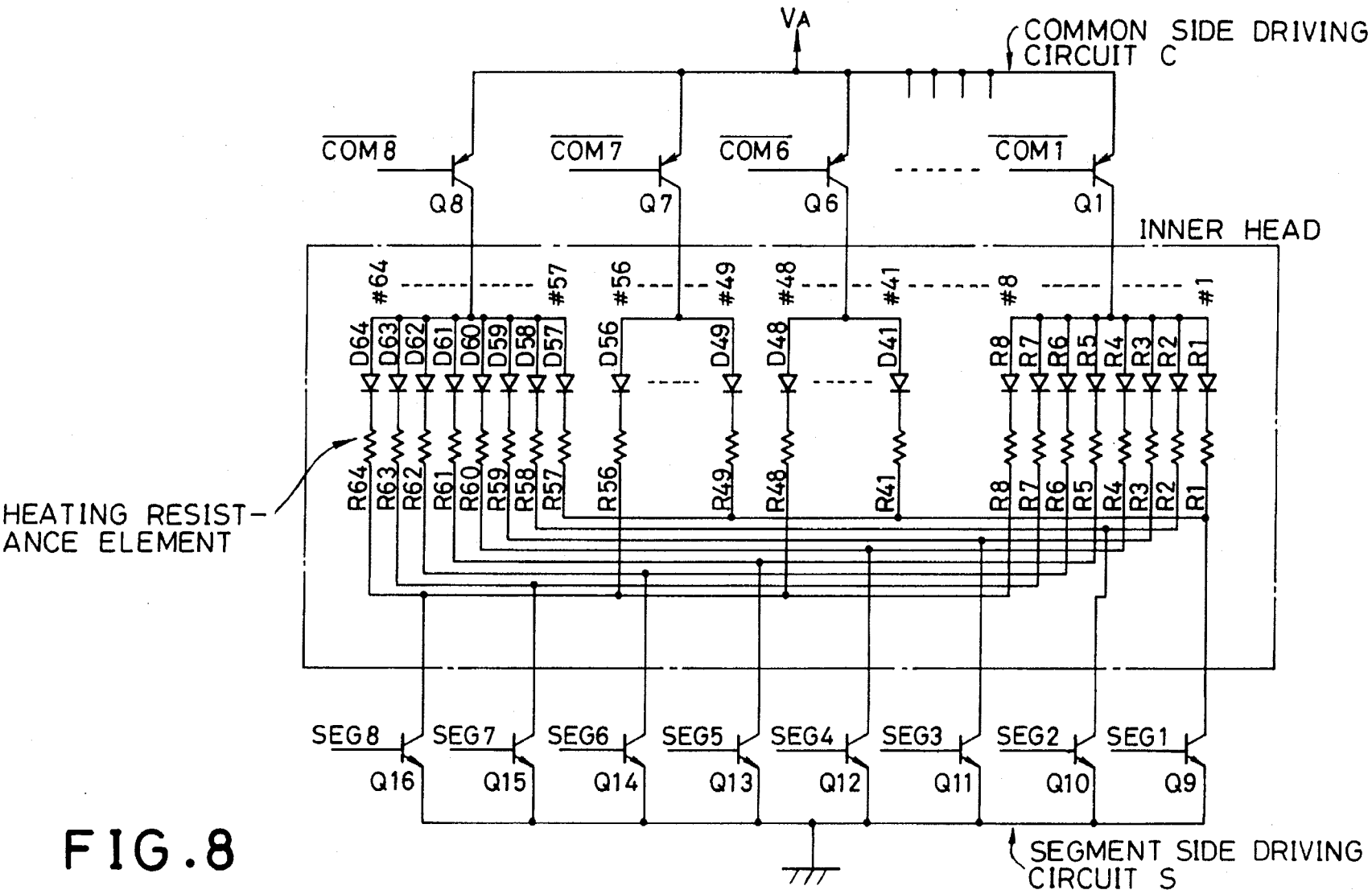
FIG. 8 is a circuit diagram illustrating one example of the recording head circuit and the head driver circuit of the printer unit shown in FIG. 7.

Circuit configurations of the ejection unit 9*a* and the head driver 116 are shown in FIG. 8, in which the ejection unit 9*a* is provided with 64 ejection outlets. Numerals #1 to #64 correspond to positions of respective ejection outlets of the ejection unit 9*a*. Reference numerals R1 to R64 denote heating resistors as ejection energy generation elements which are arranged to correspond to respective ejection outlets of the #1 to #64. The heating resistors R1 to R64 are divided into blocks, each block including 8 heating resistors. Each block is connected in common to corresponding one of the switching transistor Q1 to Q8 in a common side driver circuit C. The switching transistor Q1 to Q8 switch on/off corresponding electric lines in response to on/off control signals $\overline{\text{COM1}}$ to $\overline{\text{COM8}}$. Reference characters D1 to D64 connected to respective electric lines of the R1 to R64 are reverse-current-prevention diode.

Each group of the heating resistors which correspond to each other in position in the blocks is connected in common to corresponding one of on/off transistors Q9 to Q16 of segment side driver circuit S. The on/off transistors Q9 to Q16 switch on/off corresponding electric lines which are connected to heating resistors in response to on/off control signals SEG1 to SEG8.

Figure 9:
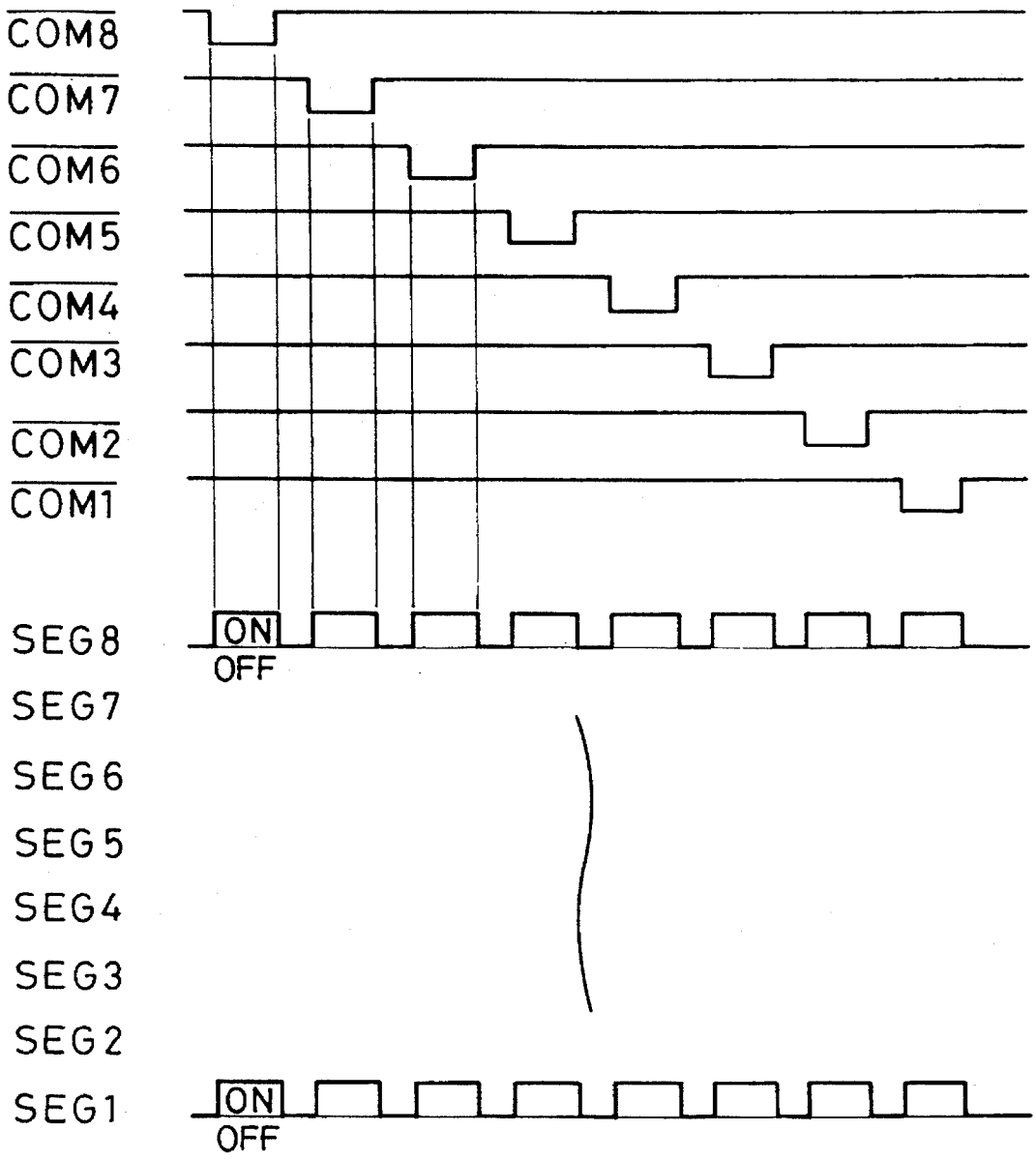
FIG. 9 is a timing chart illustrating one example of the timing of the recording head drive shown in FIG. 8.

FIG. 9 shows the timing of driving of the head 9*a* shown in FIG. 8. The common side control signals $\overline{\text{COM8}}$ to COM1 are sequentially turned on when the head is at a position in the scanning direction. By this on control one of the blocks is selected, so that it is placed in an energizable state. In the selected block in this state, segment side control signals SEG8 to SEG1 are turned on or off according to the picture data to be recorded. This causes a heating resistor or resistors in the selected block to be selectively energized, so that ink is ejected in response to heat generation of the heating resistors for carrying out dot recording on the recording medium.

Figure 10:
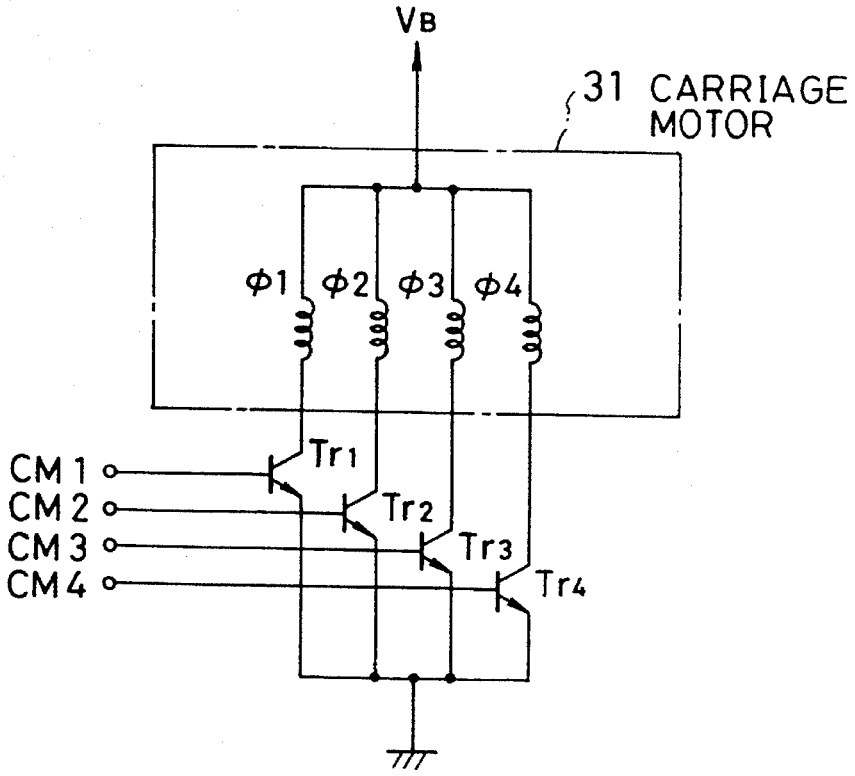
FIG. 10 is a circuit diagram showing one circuit configuration of the carriage motor and the motor driver of the printer unit shown in FIG. 7.
Figure 11:
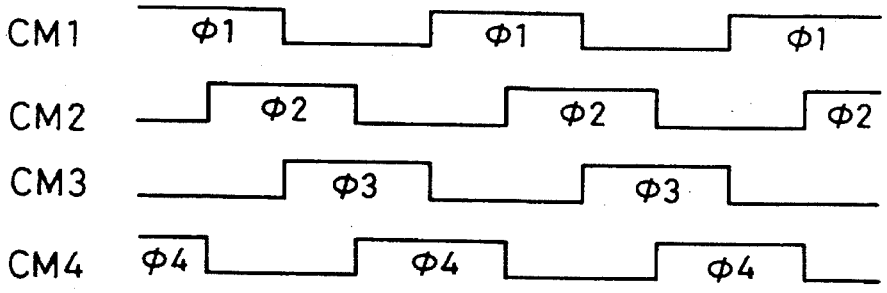
FIG. 11 is a timing chart illustrating one example of the timing of the drive of the motor shown in FIG. 10.

FIG. 10 shows an essential portion of circuit configuration of each of the carriage motor 31 and the motor driver 118 shown in FIG. 7, and FIG. 11 is a timing chart of the driving of the motor. In this embodiment, a stepping motor which has coils $\phi$1 to $\phi$4 is used as the carriage motor 31. Switching transistors Tr1 to Tr4 which are connected to each of coils $\phi$1 to $\phi$4 are appropriately turned on/off by drive signals CM1 to CM4 sent from the head controller 114, and thereby the carriage motor 31 is driven according to two-phase excitation technique as illustrated in FIG. 11.

Figure 12A:
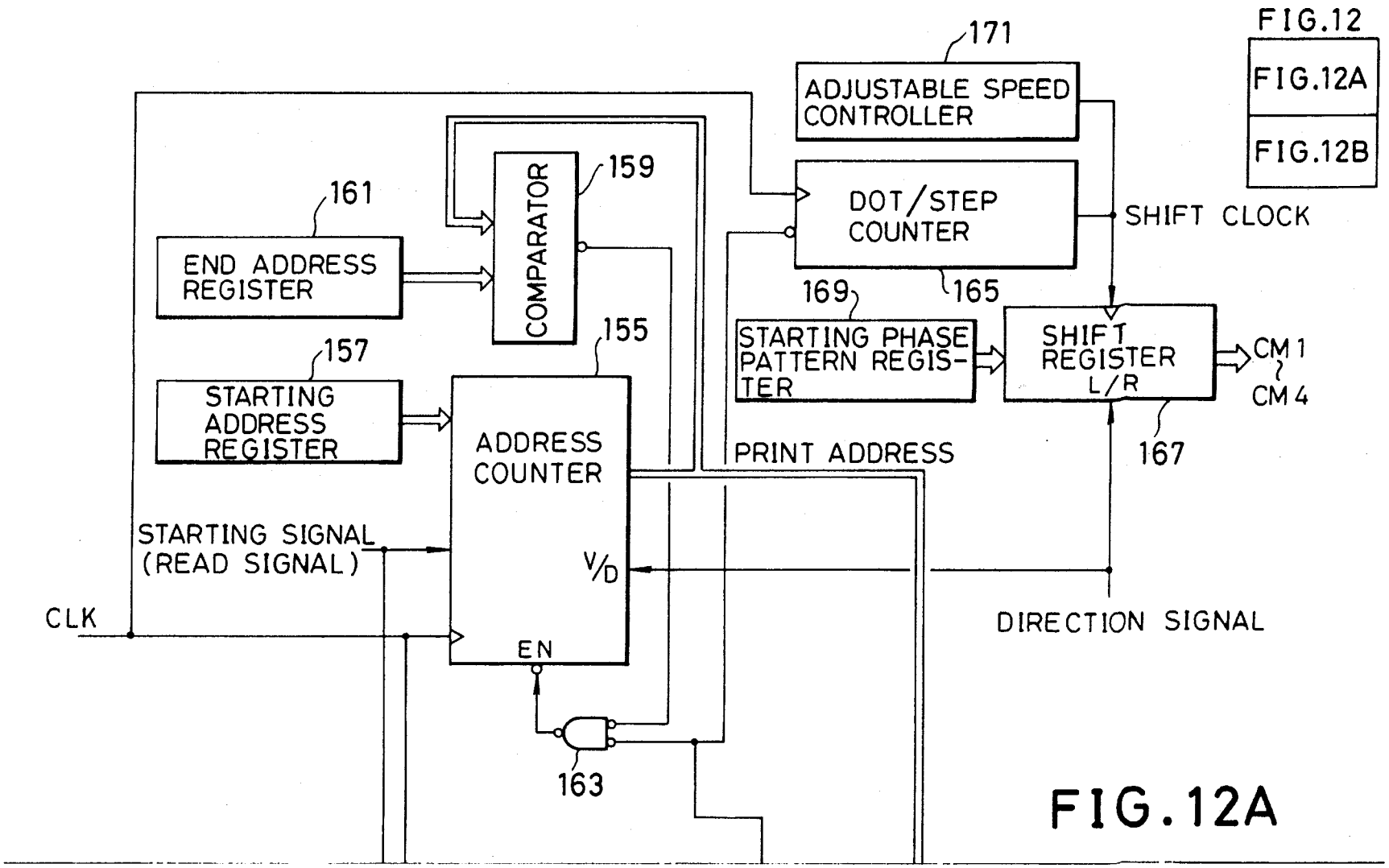
FIGS. 12A and 12B are block diagrams showing one configuration of the head controller which constitutes a control unit of the printer unit shown in FIG. 7.
Figure 12B:
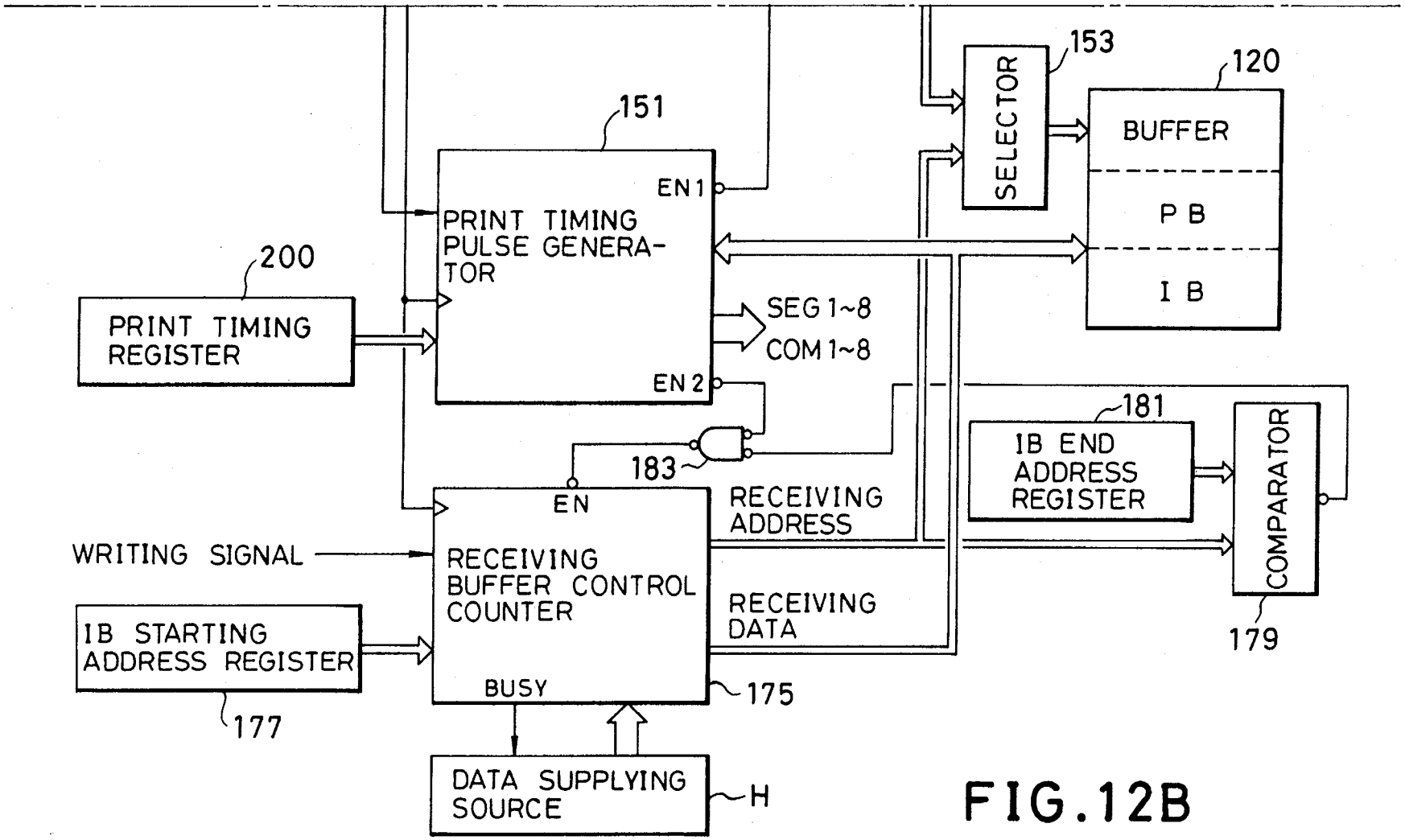

The detailed configuration of the head controller 114 of FIG. 7 is shown in FIGS. 12A and 12B, in which the reference numeral 151 denotes a print timing pulse generator. In response to input of a record starting signal (start signal) from the MPU 100, the print timing pulse generator 151 sends recording-head-drive-control signals COM1 to COM8 and SEG1 to SEG8 at timing based on the clock signal CLK. The starting signal command to read out data from record data storage area of the buffer RAM 120. In the buffer RAM 120, the reference character PB denotes an area (print buffer, or recording data buffer) which has a capacity of one line of data, for example, and in which data to be recorded is developed. The reference character IB denotes another area (receiving buffer, or input buffer) for developing data received to record. A selector 153 selects a specified address in either area PB or IB.

The reference numeral 155 denotes an address counter in the form of an up-down counter. A starting address of the recording data buffer PB stored in the starting address register 157 is set to the address counter 155. The address counter 155 starts counting in response to the input of the start signal, increases the count value according to clock signal CLK, and outputs the count value. This count value is in use an address which instructs to read out data in the recording data developing area PB, that is, a print address to read out data for recording (printing). The reference numeral 159 denotes a comparator which compares the print address outputted from the address counter 155 with an end address in the recording data buffer PB stored in the end address register 161, and judges whether or not both the addresses are equal, that is, whether or not reading out for print is completed to the end address set.

The print timing pulse generator 151 cancels enabling signal EN1 which enables address counter 155 to operate except for the periods of generation of control signals COM1 to COM8, so as to stop the counter operation through a gate 163. The operation of the address counter 155 is stopped also when the comparator 159 judges that the print address and the end address are equal.

The reference numeral 165 denotes a dot/step counter, which receives clock pulses CLK to determine print timing. In synchronism with the clock signals CLK the dot/step counter 165 generates output signals to stepping drive the carriage motor 31, which is a stepping motor, every predetermined number of dots in the carriage scanning direction. The output signals are provided to the shift register 167 which generates excitation signals CM1 to CM4 as shift clock. The reference numeral 169 denotes a starting phase pattern register which sets a phase pattern when the carriage motor 31 is starting.

In this embodiment, the address counter 155 is an up-down counter, and the shift register 167 is bidirectional register. For example, the order of reading out data from recording data buffer PB is switched by switching the count direction of the address counter 155 in response to a scanning-direction-switching signal (direction signal) provided from the MPU 100 while the carriage motor 31 is changed in rotational direction by switching the shift direction of the shift register 167. These operations enable so called bidirectional printing. Furthermore, in this embodiment, there is provided a adjustable speed controller 171 which supplies acceleration/deceleration shift clock to accelerate the carriage to rapidly reach the recording speed before reaching a recording area in the carriage scanning direction and to decelerate the carriage to rapidly stop past the recording area. The shift clock is different from the shift clock outputted from the dot/step counter 165. The adjustable speed controller 171 may include, for example, a frequency demultiplier which divides predetermined clock signals (which may be the clock signals CLK) at a set demultiplying factor, or a frequency multiplier which multiplies the predetermined clock signals at a set multiplying factor, and a memory unit (for example, a predetermined area in the program ROM 104) which stores multiplying or demultiplying factors corresponding to the acceleration/deceleration patterns, and the like part.

The reference numeral 175 denotes a receiving buffer control counter which outputs to the selector 153 a signal assigning a receiving buffer address (receiving address) of a storing destination in storing receiving data in the receiving buffer IB. The receiving buffer control counter 175 sets a starting address in the receiving buffer IB stored in the IB starting address register 177, is activated in response to a write signal, increases the count value in synchronism with the clock signals CLK, and outputs the count value. The reference numeral 179 is a comparator which compares the receiving addresses (count value) outputted from the receiving buffer control counter 175 with the end address in the receiving buffer IB stored in the IB end address register 181, and judges whether or not both are equal, that is, the storing of the receiving data is completed to the IB end address set.

During the periods of generation of the signals COM1 to COM 8, the print timing pulse generator 151 eliminates an enabling signal EN2 which permits the receiving buffer control counter 175 to operate. This causes the operation of the receiving buffer control counter 175 to be stopped as well as to send a busy signal BUSY to the sending station of the recording data (data supplying source H) to notify that it is unable to receive data. Also when the comparator 179 judges that the IB end address and the receiving address are the same, the operation of the receiving buffer control counter 175 is stopped.

The data supplying source H serves as a host to the head controller 114, and may be external equipment 132, such as a word processor and a personal computer, connected to the address data bus 122 through a centronics interface 131, for example, as shown in FIG. 7. Alternatively, the data supplying source H may be the RAM 106 storing document data (text) inputted from such as an external equipment without modification. The data received from the data supplying source H is developed in the receiving buffer IB. After being read out from the receiving buffer IB, at appropriate timing before recording, the data is processed in a format to fit to recording and is then developed in the recording data buffer PB.

Predetermined areas of the RAM 106 may be used as registers 157, 161, 169, 177 and 181 in this case. Furthermore, the adjustable speed controller 171 may be realized by software controlling of the MPU 100.

Figure 13:
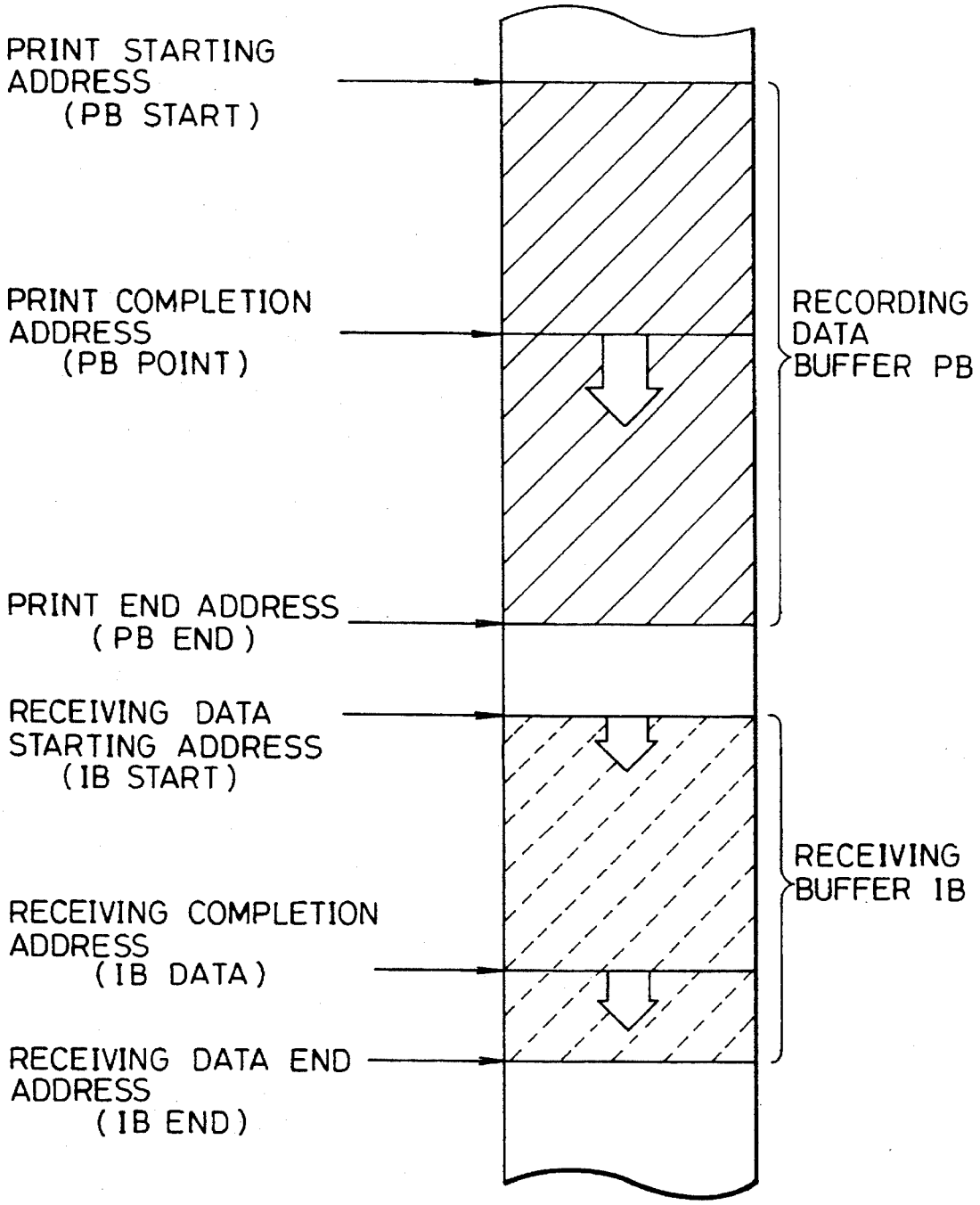
FIG. 13 is an illustration of one example of a space allocation in the memory space of the buffer area shown in FIG. 12B for storing recording data.

FIG. 13 shows an example of a memory allocation of each of the recording data buffer PB and the receiving buffer IB in the memory space in the buffer RAM 120. As shown in FIG. 13, the area from the print starting address PBSTART to the print end address PBEND which are respectively indicated by the starting address register 157 and the end address register 161 constitutes the recording data buffer PB. On the other hand, the area from the starting address IBSTART to the reception data end address IBEND which are respectively designated by the IB starting address register 177 and the IB end address register 181 serves as the receiving buffer IB. In FIG. 13, the reference character PBPOINT denotes a pointer (printer completion address pointer) which indicates an address at which printing of the data in the recording data buffer PB has been completed, and corresponds to the count value of the address counter 155. The reference character IBDATA denotes an address (data reception completion address) to which data reception in the receiving buffer IB has been completed, and corresponds to the count value of the receiving buffer control counter 175.

Figure 14:
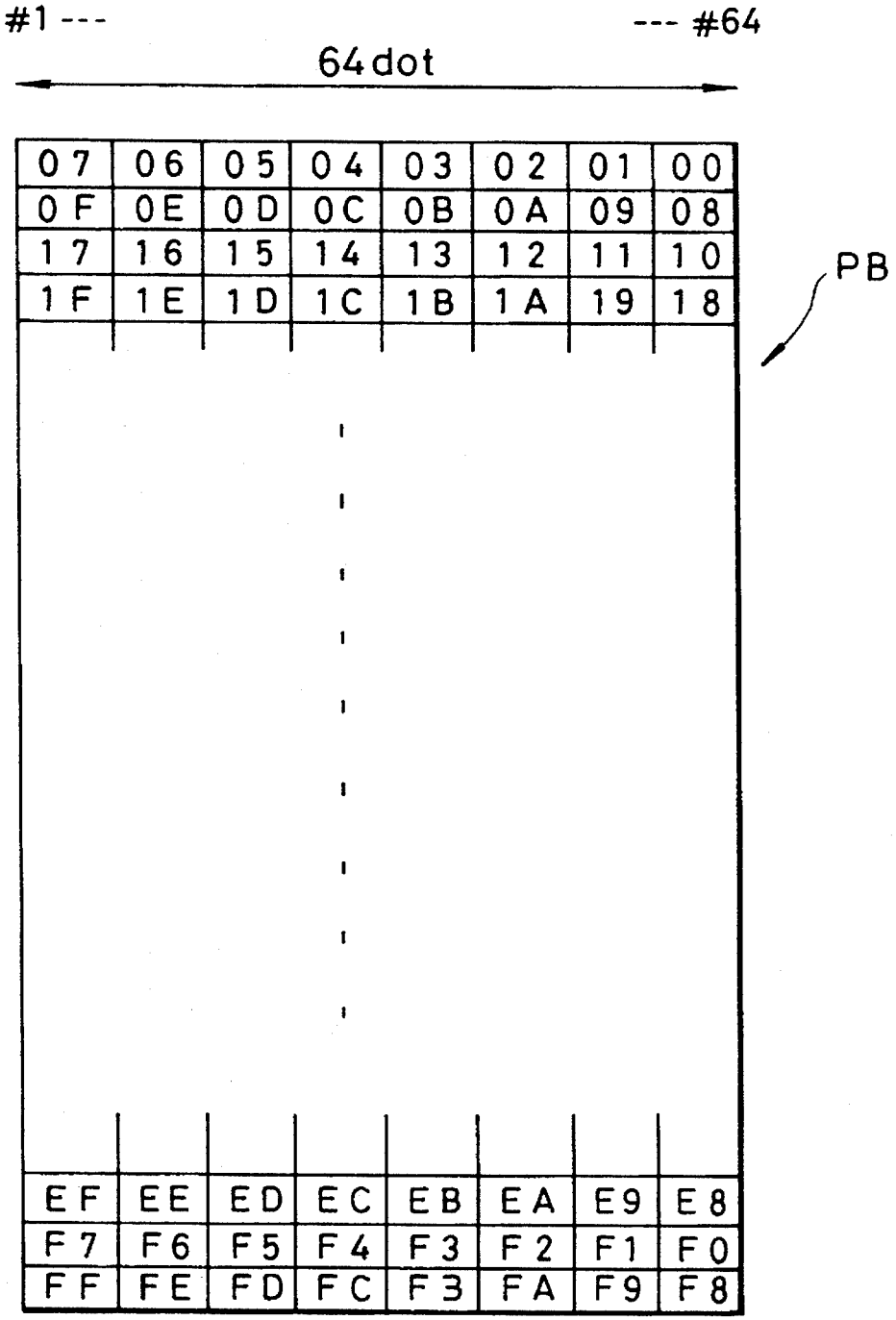
FIG. 14 is an illustration of an address mapping of the recording data buffer area in the buffer shown in FIG. 13.

FIG. 14 shows an address mapping of the recording data buffer PB shown in FIG. 13. Each address "00" to "FF" (hereinafter referred to as address $00 to $FF) may store 8 bit data, and each bit corresponds to one dot of recording data. Therefore, the number of bits contained in each of the address groups of $00 to $07, $08 to $OF, . . . , $F8 to $FF correspond to 64 dots which correspond to the number of the whole recording elements. In each of the address groups, each address corresponds to ejection outlets number #1 to #64 as shown in FIG. 14. In practice, data of one line (which is recorded by one scan of the recording head) is developed in the recording data buffer PB, but in FIG. 14 only addresses to $FF are shown for simplification of illustration.

On the contrary, to the constitution of the recording data buffer PB which corresponds to the practical dot recording data, the receiving buffer IB stores, for example, character code data received from the data supplying source H, without changing, and is hence small in scale as data area as compared to the recording data buffer PB.

Figure 15:
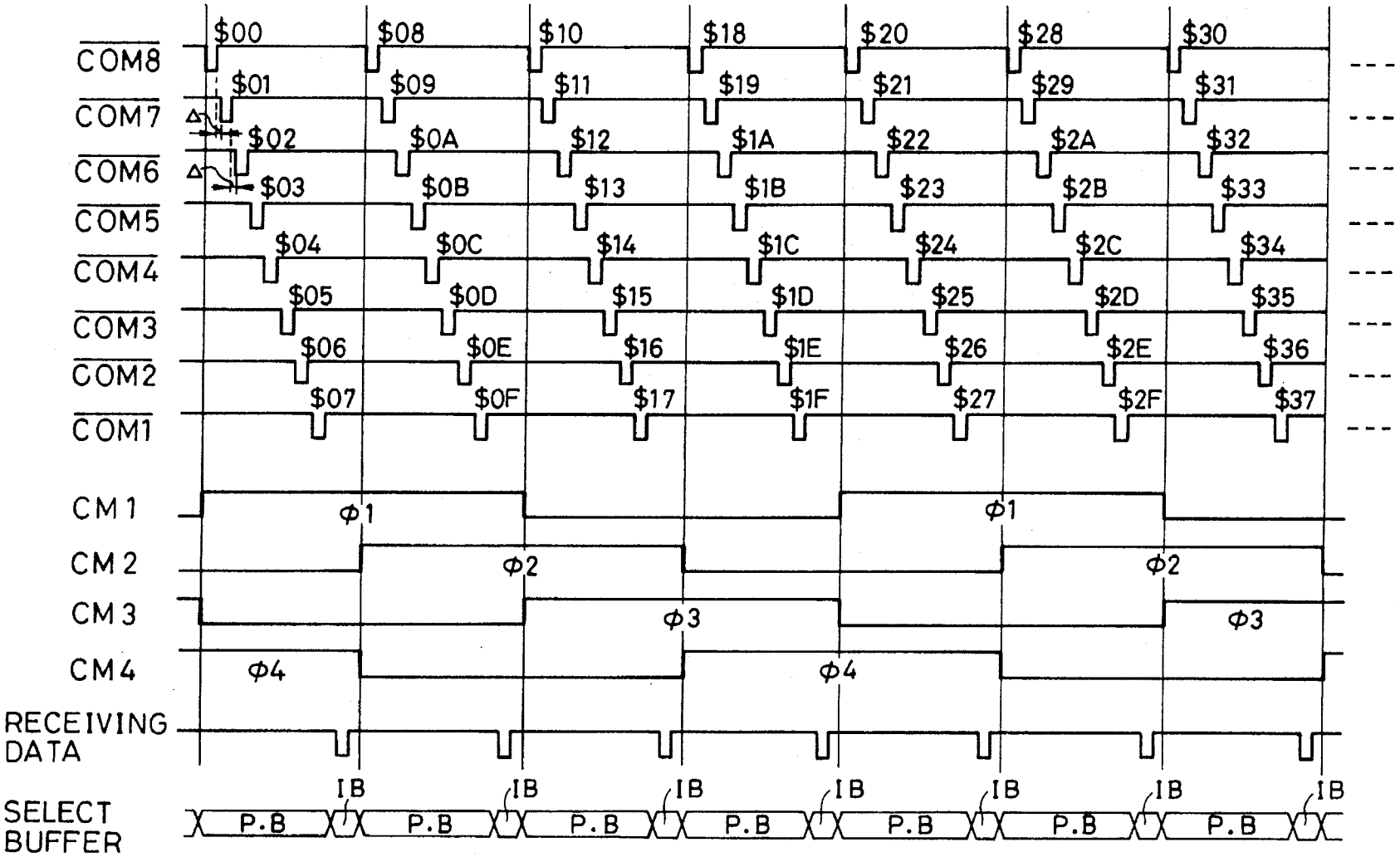
FIG. 15 is a timing chart illustrating one example of the operation timing of each part of the head controller shown in FIGS. 12A and 12B.

FIG. 15 illustrates relationships in recording among output timing of common side head drive control signals COM8 to $\overline{\text{COM1}}$, output timing of motor drive signals CM1 to CM4, timing of data receiving, and timing of selection of the areas PB and IB. In FIG. 15, each one dot in the scanning direction corresponds to one step of the motor.

When recording is carried out at a position in the scanning direction, the recording data buffer PB is, as shown in FIG. 15, selected, and an address (for example, $00 to $07) where data to be printed at that position is stored, is sequentially assigned to thereby select and output data in the corresponding addresses. More specifically, signals $\overline{\text{COM8}}$ to $\overline{\text{COM1}}$ are sequentially outputted, and at the timing of outputting of each of these signals, segment side head drive control signals SEG8 to SEG1 are, as shown in FIG. 9, outputted to correspond to recording data, and thereby conduct printing. When the recording at the position is completed, the receiving buffer IB is selected to store receiving data.

Figure 16:
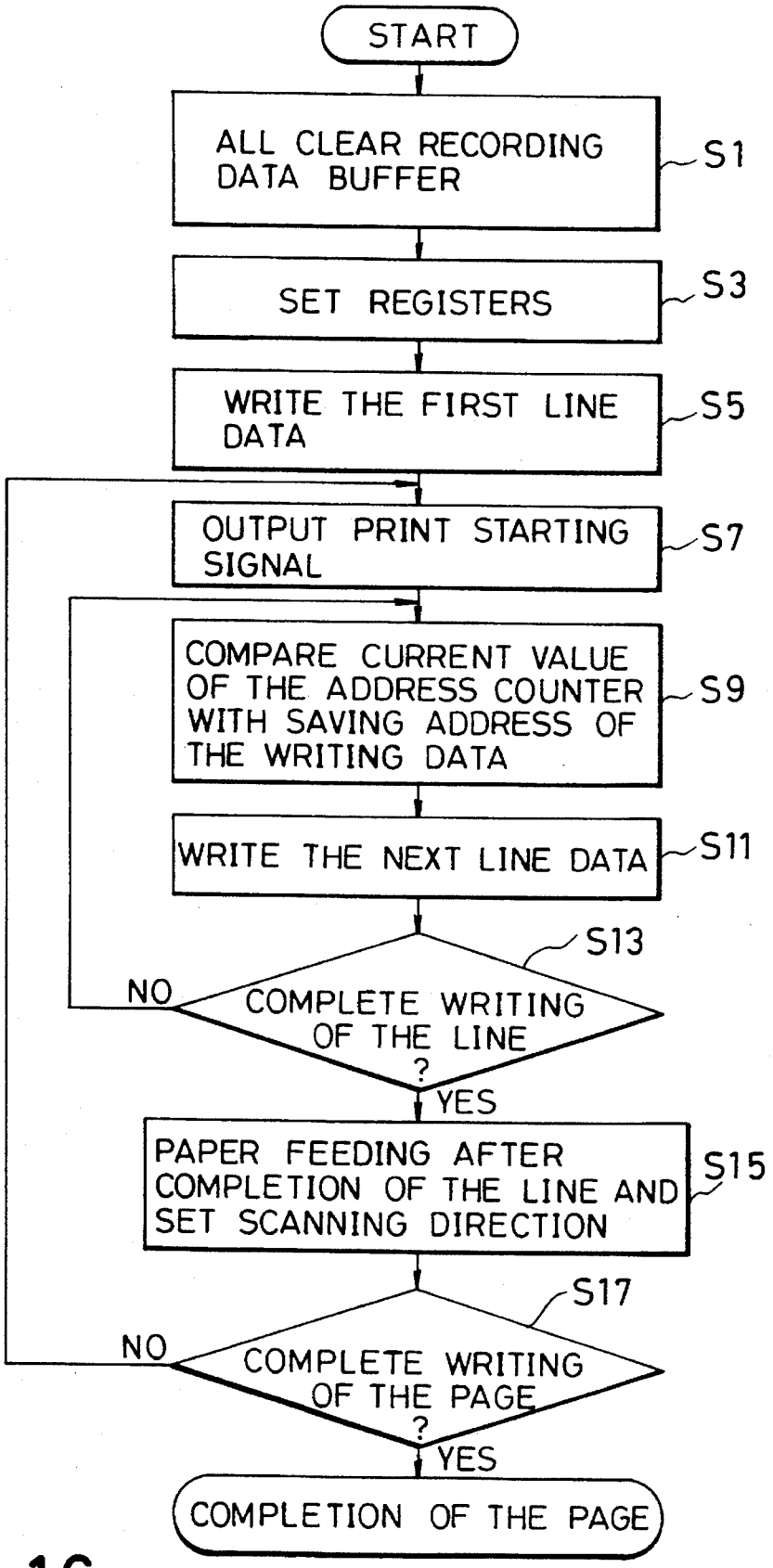
FIG. 16 is a flowchart illustrating one example of a routine in recording according to the one embodiment of the present invention.

FIG. 16 illustrates an example of a procedure of recording according to this embodiment. After the routine is started, in step S1 the recording data buffer PB is all cleared to prepare writing of recording data. Then in step S3, setting of the various registers 157, 161, 169, 200 previously mentioned is made: the number of dots per one step, the print starting address PBSTART and the print end address PBEND in the recording data buffer PB, recording direction, start excitation phase pattern of the carriage motor 31, etc are set. Here, the end address PBEND is set to add the starting address PBSTART and an address corresponding to a recording width of one line. Next, in step S5, one line of character code data or the like read out from the receiving buffer IB is converted to dot pattern data, by using the character generator ROM 108, and is then developed in a predetermined area in the RAM 106, for example. The data developed is transferred to and written in the recording data buffer PB as the first line dot data.

Subsequently in step S7, the printing operation is started by outputting a print starting signal to the address counter 155 and the print timing pulse generator 151. More specifically, the address counter 155 generates addresses by up-counting or down-counting according to record direction signals. On the basis of the addresses generated, dot data is read out from the data buffer PB, and is supplied to the recording head. During the recording operation, the next line of data is written in the recording data buffer PB, the next line is next to the line which corresponds to the address position, of which data has been recorded. More specifically, in step S9 the current value of the address counter 155 and the next line storing address are compared, and when the printing of the data of the current line is completed, in step S11 the data of the next line is written in the addresses. This writing operation may be executed during intervals between adjacent common side drive signals, that is, during the intervals shown in FIG. 15. It is to be noted that the recording operation may be carried out by the operation of the address counter 155 and the print timing pulse generator 151, and hence that the MPU 100 may execute other operations in any period of generation of the common side drive signals. Receiving and processing of data to be stored in the recording data buffer PB will be described hereinafter with reference to FIG. 17.

The operations of steps S9 and S11 are executed on each recording position in the scanning direction until the processing of one line of data is completed (step S13). Accordingly, when the recording of the one line of data is completed, the data of the next line is developed in the recording data buffer PB. After the printing of the one line, in step S15 a feed of the recording medium and recording direction to perform reciprocal printing are reset. Furthermore, the print starting address PBSTART and the print end address PBEND are reset. The procedure after step S7 is repeated until one page of printing is completed (step S17). Here, the backward printing is reverse in set addresses of both the print starting address PBSTART and the print end address PBEND to the forward printing.

Figure 17:
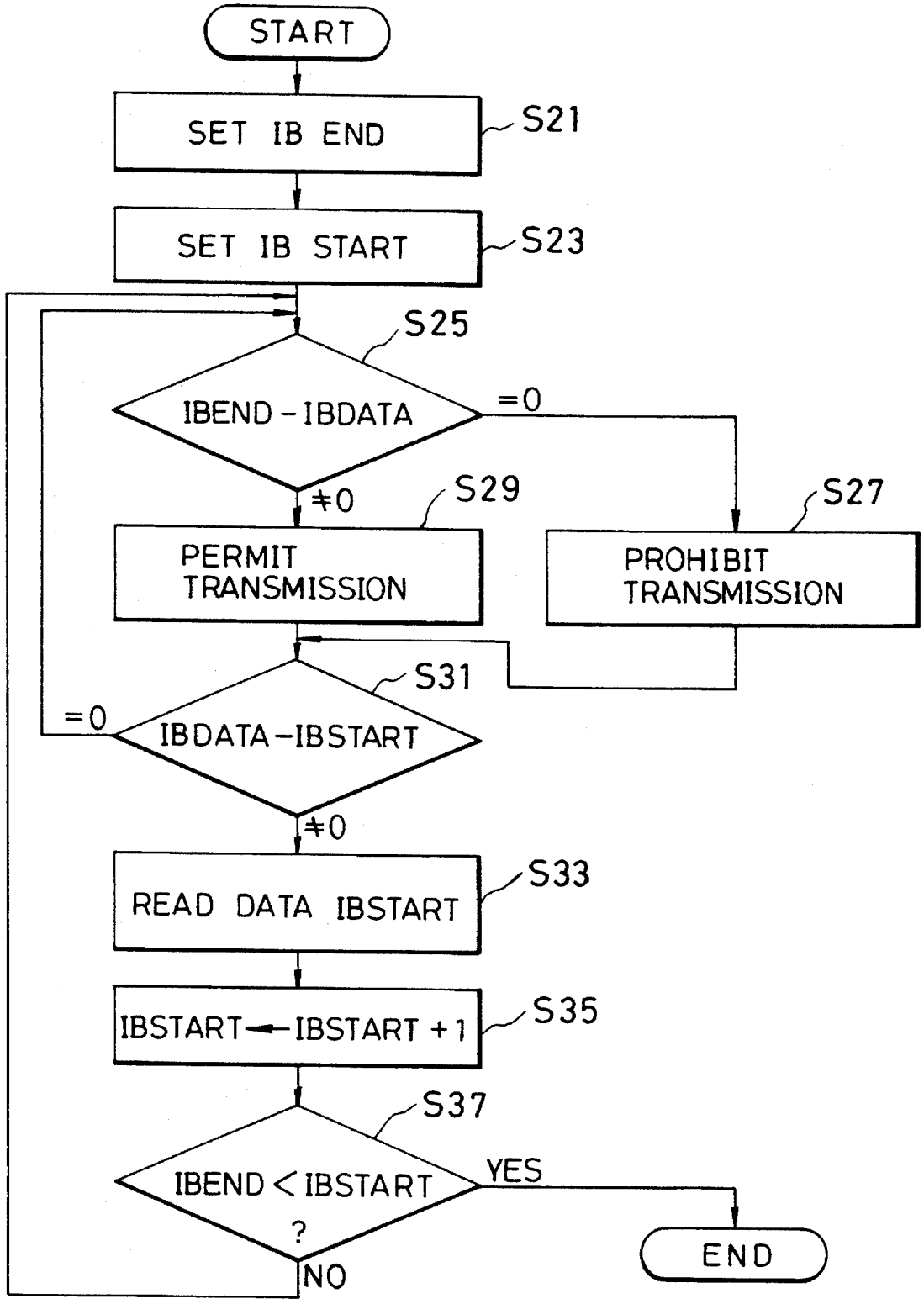
FIG. 17 is a flowchart illustrating one example of a routine in data receiving.

FIG. 17 shows an example of operation of the printer controller after the common side signals COM8 to COM1 output, that is, when data is received after recording in a position in the scanning direction. According to this procedure, in step S21 a receiving data end address IBEND is set in the IB end address register 181, and in next step S23 a receiving data starting address IBSTART is set in the IB starting address register 177.

Then, in step S25 the receiving data end address IBEND and a data receiving completion address IBDATA are compared. When both addresses are equal, in step S27 a signal representing that data reception is not possible, is sent to the data supplying source H since one line of data has been already received. On the other hand, when both the addresses are not equal, in step S29 transmission is permitted to the source H. These operations of steps S25, S27 and S29 are executed by the comparison by the comparator 179 in FIGS. 12A and 12B, and by output/inactivate of a BUSY signal by the receiving buffer control counter 175 when both addresses are equal or not equal. The data supplying source H performs transmission of data in response to the transmission permission (cancellation of the BUSY signal).

Subsequently, in step S31 the current values of the data receiving completion address IBDATA and the starting address IBSTART are compared. When both addresses are equal, it is in a state that the data supplying source H does not transmit data, so that the MPU stands by. On the other hand, in the case in which the both addresses are not equal, the MPU goes to step S33, where the data stored in the address indicated by the current value of the starting address IBSTART is read out, and appropriate processing such as conversion to dot data from the data read out is carried out. The processed data is stored in a predetermined area in the RAM 106. The data stored is developed in the recording data buffer PB at the timing during the recording operation as previously described.

Then, in step S35 the starting address IBSTART is incremented by +1, and in subsequent step S37 it is judged whether or not the incremented address value exceeds the receiving data end address IBEND. When in this step the judgement is the affirmative, the reading out operation of one line of reception data has been completed, and thus the routine of FIG. 17 is finished. In the case where the judgement is the negative, the MPU returns to step S25, and repeats the procedures of step S25 and after step S25.

Figure 18:
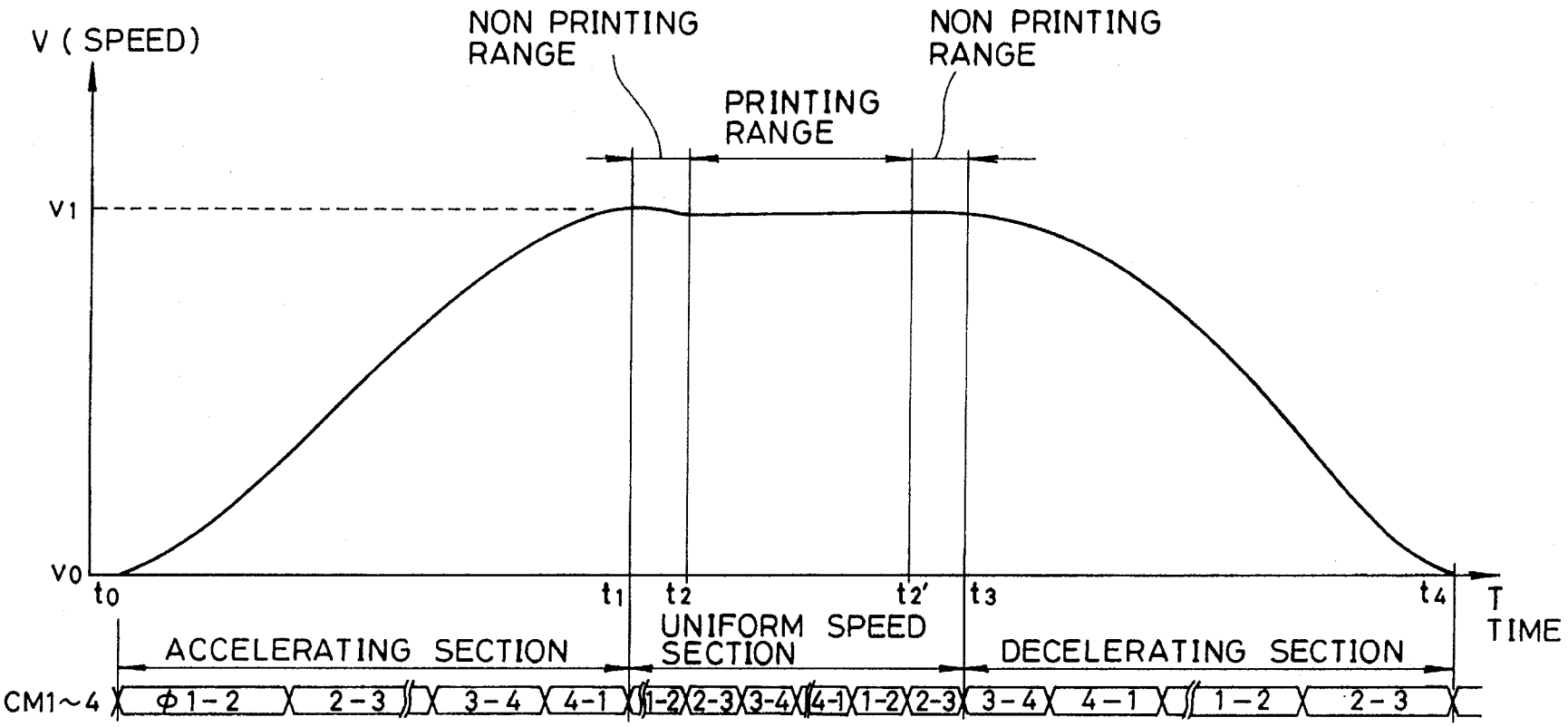
FIG. 18 is an illustration of the relationship between the exciting phase switching time of a carriage motor and the carriage speed, being adoptable in the one embodiment of the present invention.

FIG. 18 illustrates the relationship between the exciting phase switching time of the carriage motor 31 and the carriage speed. To move the carriage 11 at a constant speed it is, as shown in FIG. 18, possible to rapidly accelerate the carriage 11 by the control of the adjustable speed controller 171 from an initial speed Vo=0 to a constant speed V1 at printing (to–t1) before a printing range, and then to stop the carriage 11 by rapidly decelerating it from the speed V1 to the initial speed Vo (t1–t4) after the printing range. In the periods in which changes from the acceleration to the constant speed and from the constant speed to the deceleration are made, there are provided non printing ranges (t1–t2 and t2'–t3), so that both over shooting in the point of time to switch the acceleration to the uniform speed traveling and undershooting in the point of time to switch the uniform speed traveling to the deceleration are absorbed. Thus, printing is delayed a time period to reach a stable uniform speed speed V1. This may be performed by using a buffer region as a region where any recording data is not written ("0" written region), the buffer region is corresponding to several dots (for example, 8 dots) in the scanning direction from the print starting address PBSTART. The buffer region (data non-written region) may be variable in length according to the recording speed and the acceleration pattern.

Moreover, the position of the print starting dot may be optionally set by using the non-printing range described above. During printing in opposite directions, vertical misregistration in the forward and backward printing can take place due to various factors such as dispersion of mechanical assembly accuracy, changes in frictional force of mechanical parts and in elastic force of rubber owing to a change in environmental temperature, a change of the control table owing to a change in travel distance of the carriage 11, etc. In this event, in at least one of the forward and backward printing, the print starting position may be adjusted in the unit of a dot by making a correction to the print starting address. That is, correction of the print starting address within a range of the non-printing range enables vertical misregistration of the print to be corrected with ease only by changing the print data pointer without providing any influence to other portions.

Figure 20A:
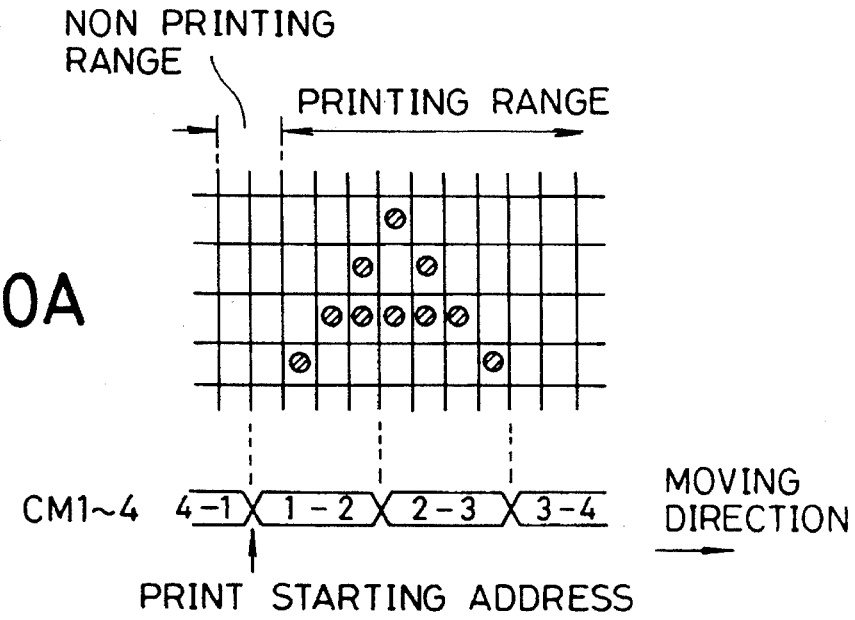
FIGS. 20A, 20B and 20C are views illustrating timing of correcting operations of difference of recording position according to one embodiment of the present invention.

A case to correct a print starting address in the forward printing will be described as a specific example. In this embodiment, the forward printing is performed by traveling the head 9 to the right in FIG. 2, and the non-printing range has a two dot length as shown in FIG. 20A. A buffer region corresponding to the two dots is secured in the recording data buffer PB. The buffer region is the data non-written region ("0" is written), and hence it is possible to produce a non-printed region having two dots at maximum by executing printing with an address, corresponding to this buffer region, as the print starting address. The starting address is stored in the starting address register 157, and may be changed according to the print misregistration factors as above mentioned.

When it is not necessary to correct misregistration, as shown in 20A, the print starting address is set in the starting address register 157 so that the substantial non-printing range has one dot i.e. a half of maximum dot. This enables printing to be executed in a neutral state in which misregistration at the front and the rear of a print can afford to be corrected by one dot in the head traveling direction.

Figure 20B:
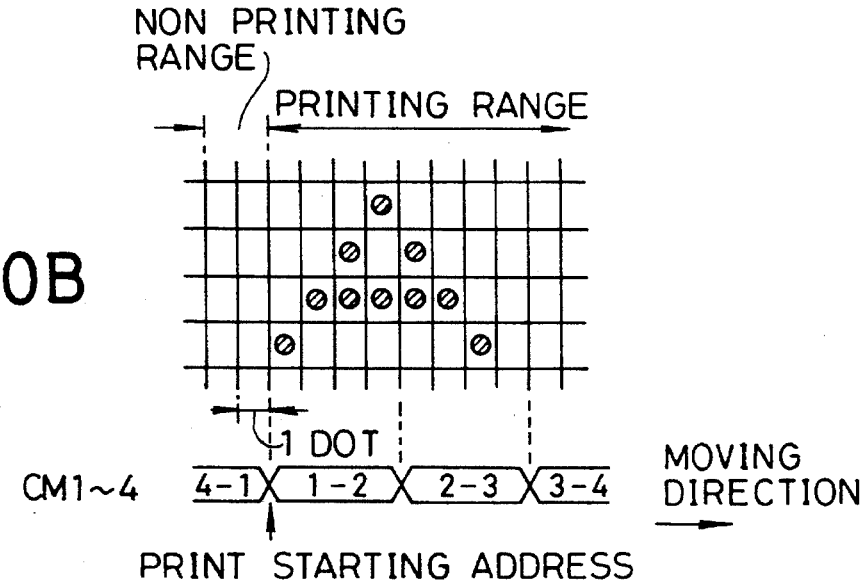

FIG. 20B illustrates a case where the set address of the starting address register 157 is shifted up one address. In this case, the print starting address is shifted one dot, and hence the printed line is shifted one dot to the left. On the contrary, in the case where the set address of the starting address register 157 is shifted down one address, the print is shifted one dot to the right. Such misregistration corrections in the unit of one dot may be achieved also in backward printing. In this case, the set value of the starting address register 157 may be changed just before the start of the backward printing. Moreover, it is possible to conduct a misregistration correction relative to the forward print in the backward printing whereas no misregistration correction is made in the forward printing.

Moreover, in the relationship as shown in FIG. 15 between the output timing of common side control signals $\overline{COM8}$ to $\overline{COM1}$ and the output timing of the motor drive signals CM1 to CM4, time intervals between change points of signals CM1 to CM4 and falling change points of the signal $\overline{COM8}$ may be arbitrarily set in the course of in the period $00 and $08. In this manner, print position adjustment can be achieved within one dot in the head traveling direction. That is, a fine misregistration correction within one dot may be performed by adjusting the timing of the change time of the falling of the signal $\overline{COM8}$ relative to signal CM1 to CM4 which is a top signal of the common side control signals $\overline{COM8}$ to $\overline{COM1}$ within the print time of the first dot of the print start. Such timing adjustment is carried out by the print timing pulse generator 151 which outputs the enabling signal EN1 to the dot/step counter 165 so as to control this output timing on the basis of the set value of the print timing generator 200. It is possible to change the set value of the print timing generator 200 to correspond to various print misregistration factors as mentioned above, for example, temperature.

Figure 20C:
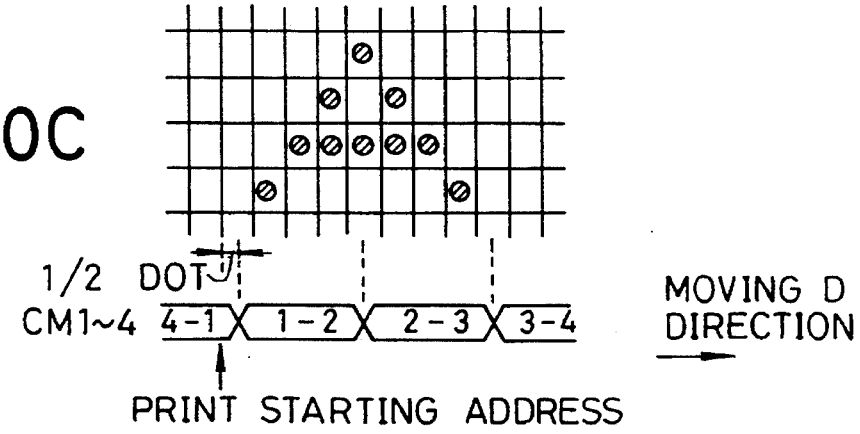

A specific example in which in forward printing such a fine misregistration correction is achieved will be described. FIG. 20C illustrates a case where the change timing of the falling of the signal $\overline{COM8}$ is shifted earlier by the print time of ½ dot than in FIG. 20A. In this case, the print of the whole line is shifted ½ dot to the left. Such a misregistration correction within one dot may be carried out also in the backward printing.

Moreover, vertical misregistration corrections in both the forward and backward printing can be performed finely and exactly in a wide range by the combination of the two misregistration corrections previously mentioned: that is, the combination of the misregistration correction in the unit of one dot by data point adjustment at the print starting dot position using the starting address register 157 and the fine misregistration correction within one dot by print start timing adjustment using the print timing generator 200.

In conventional printers of which carriage traveling speed is not sufficiently high, the print efficiency is enhanced by moving the carriage only in regions where print data exists, and thereby the printing speed is improved. In the case in which the traveling speed of the carriage is, however, sufficiently high (the carriage and the carrier return are equal in traveling speed), such a fine control of the carriage may produce disadvantages such that the carriage cannot keep up with the processing speed, resulting in deterioration in print efficiency. In this case, the carriage may be moved through the full span in the printing range regardless of data range or not data range while the misregistration correction is carried out according to the embodiment previously described. This prevents the printing speed to be reduced, and enables the control of the carriage to be simplified.

(i) Second Embodiment

In the second embodiment of the present invention, the correction of the print misregistration may be distributed to both the forward and backward printing. More specifically, positions of prints are shifted in both the forward and backward printing from normal print positions. By distributing ½ of the misregistration correction to each printing direction, it is thus possible to make corrections so that prints are placed at constant positions relative to normal print positions of the printer.

(ii) Third Embodiment

As an external print misregistration adjusting means, a DIP (dual-in-line package) switch (not shown) may be used to set a correction. This DIP switch enables the set value to be adjusted to the dispersion of each printer after the assembly of the printer, and thereby the print misregistration at mass production may be minimized.

As external indication means adjusting print misregistration, use may be made of a temperature detector, such as a thermistor, to detect the environmental temperature. At a low temperature, a correction according to the detected temperature may be provided to the head controller 114, and thereby print misregistration can be minimized at a wide range of temperatures.

(iii) Fourth Embodiment

In the preceding embodiments, description has been made on the ink jet type serial printer, but the present invention is not limited to this type of printer. The present invention may be applied to other types of serial printers of other recording systems. Among generally used printers, there is a type of printer of which a head holds and prints a column (for example, 64 dots) of data at the same time. This type of printer is often used in thermal transfer printers, and has a merit of reducing the number of signal lines to the head.

Figure 19:
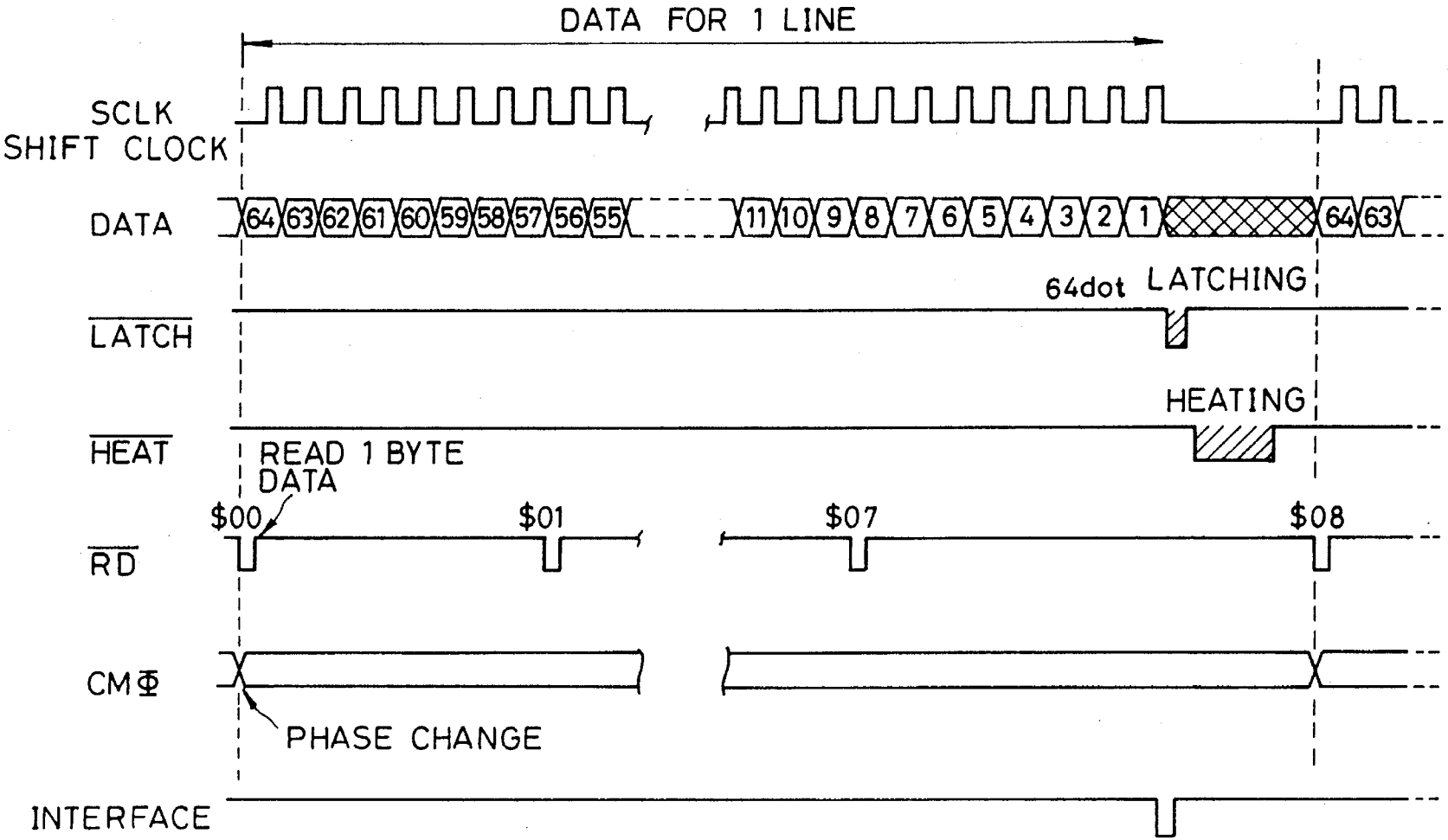
FIG. 19 is a timing chart illustrating the control operation of another embodiment of the present invention.

In this printer, use may be made of a recording head having a shift register, a latch and a driver incorporated in it, and data may be, as illustrated in FIG. 19, serial transferred. Data (DATA) to be transferred is held in a latch by a shift clock (SCLK) and a latch signal ($\overline{LATCH}$), and the data held is simultaneously outputted to the driver by inputting a heat signal ($\overline{HEAT}$). In response to the output data the heat operation is performed, and then the motor excitation phase (CM) is switched. This enables the traveling of the head to be synchronized with the heat timing. Preferably, receiving data is read in after a column of data is sent, taking the receiving interface into consideration, and then the motor excitation phase is switched. Also in this embodiment, print misregistration may be carried out as in the first embodiment.

ADDITIONAL DESCRIPTION

The present invention achieves distinct effects when applied to a recording head or a recording apparatus which has means for generating thermal energy such as electrothermal transducers or laser light, and which causes changes in the ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the thermoelectric transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.– 70° C. so that the viscosity of the ink is maintained at such a value that the ink can be ejected reliably.

In addition, the present invention can be applied to such apparatus where the ink is liquefied just before the ejection by the thermal energy so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The invention has been described in detail with respect to preferred embodiments, and it will now be apparent from the foregoing to those skilled in the art that changes and modifications may be made without departing from the invention, therefore, in the appended claims to cover all such changes and modifications as fall within the true spirit of the invention.

What is claimed is:

1. A printer controller for a serial printer in which a recording head is scanned for recording in forward and backward directions, said recording head being adapted to produce an image in a dot matrix, said controller comprising:

an addressable buffer memory for storing print data, said addressable buffer memory including a print region capable of storing the print data and a non-print region having a space data corresponding to predetermined dots, wherein the print region corresponds to a recording region of one line on a recording medium, and wherein the non-print region in said addressable buffer memory is allocated on an address preceding the print region;

transferring means for transferring the print data from said addressable buffer memory to said recording head according to an address outputted from an address counter;

setting means for setting said recording head to be scanned in a forward or backward direction;

drive control means for driving and scanning said recording head according to the direction set by said setting means;

a first register unit for setting a starting address into said address counter of said transferring means to adjust a print start dot position in response to the direction set by said setting means immediately before at least one of a forward or backward printing start time, the starting address indicating an address in the non-print region; and a second register unit for setting into said drive control means an initial value to adjust print start timing relating to a scanning position of said recording head in response to the direction set by said setting means immediately before at least one of a forward or backward printing start time.

2. A printer controller as claimed in claim 1, wherein said addressable buffer memory stores print data in print form.

3. A printer controller as claimed in claim 1, wherein said second register unit sets a time interval between a change point of a drive signal of a carriage motor and a change point of a print signal of said recording head within a print time period of one dot.

4. A printer controller as claimed in claim 3, wherein said second register unit performs the setting of the time interval by changing a set value of a print timing register.

5. A printer controller as claimed in claim 1, further comprising distributing means for providing at least one of said first register unit and said second register unit with a correction amount of print misregistration distributed to the forward printing and backward printing.

6. A printer controller as claimed in claim 1, further comprising:

temperature detecting means for detecting an environmental temperature around said printer; and indication means for providing at least one of said first register unit and said second register unit with a correction amount to correct print misregistration in response to a detected value of said temperature detecting means.

7. A printer controller as claimed in claim 1, further comprising data setting means for setting an amount of adjustment to correct print misregistration to said first register unit and said second register unit.

8. A printer controller as claimed in claim 7, wherein said data setting means comprises a DIP switch.

9. A printer controller as claimed in claim 1, wherein said drive control means is adapted to move said recording head in a full scan within a print range throughout printing.

10. A printer controller as claimed in claim 1, wherein said recording head comprises an electrothermal transducer, and thermal energy generated by said electrothermal transducer producing film boiling of ink so that growth of bubbles caused by the film boiling ejects the ink.

11. A printer controller as claimed in claim 1, wherein said address counter comprises an updown counter.

12. A printer controller as claimed in claim 11, wherein said address counter performs upcounting or downcounting in response to a print direction signal.

13. A printer controller as claimed in claim 3, wherein said carriage motor is a stepping motor and the drive signal is an excitation phase signal.

14. A printer controller for a serial printer in which a recording head is scanned for recording in forward and backward directions, said recording head being adapted to produce an image in a dot matrix, said controller comprising:

an addressable buffer memory for storing print data, said addressable buffer memory including a print region capable of storing the print data and a non-print region having a space data corresponding to predetermined dots, wherein the print region corresponds to a recording region of one line on a recording medium, and wherein the non-print region in said addressable buffer memory is allocated on an address preceding the print region;

transferring means for transferring the print data from said addressable buffer memory to said recording head according to an address outputted from an address counter;

setting means for setting said recording head to be scanned in a forward or backward direction;

drive control means for driving and scanning said recording head according to the direction set by said setting means; and a register unit for setting a starting address into said address counter of said transferring means due to adjust a print start dot position in response to the direction set by said setting means immediately before at least one of a forward or backward printing start time, the starting address indicating an address in the non-print region.

15. A printer controller as claimed in claim 14, wherein said addressable buffer memory stores print data in print form.

16. A printer controller as claimed in claim 14, further comprising distributing means for providing said register unit with a correction amount of print misregistration distributed to the forward printing and backward printing.

17. A printer controller as claimed in claim 14, further comprising:

temperature detecting means for detecting an environmental temperature around said printer; and indication means for providing said register unit with a correction amount to correct print misregistration in response to the detected value of said temperature detecting means.

18. A printer controller as claimed in claim 14, further comprising data setting means for setting an amount of adjustment to correct print misregistration to said register unit.

19. A printer controller as claimed in claim 18, wherein said data setting means comprises a DIP switch.

20. A printer controller as claimed in claim 14, wherein said drive control means is adapted to move said recording head in a full scan within a print range throughout printing.

21. A printer controller as claimed in claim 14, wherein said recording head comprises an electrothermal transducer, and thermal energy generated by said electrothermal transducer producing film boiling of ink so that growth of bubbles caused by the film boiling ejects the ink.

22. A printer controller as claimed in claim 14, wherein said address counter comprises an updown counter.

23. A printer controller as claimed in claim 22, wherein said address counter performs upcounting or downcounting in response to a print direction signal.

24. A serial printer comprising:

recording head means for recording an image in a dot matrix;

scanning means for scanning said recording head;

driving means for driving said recording head; and a printer controller comprising:

an addressable buffer memory for storing print data, said addressable buffer memory including a print region capable of storing the print data and a non-print region having a space data corresponding to predetermined dots, wherein the print region corresponds to a recording region of one line on a recording medium, and wherein the non-print region in said addressable buffer memory is allocated on an address preceding the print region;

transferring means for transferring the print data from said addressable buffer memory to said recording head according to an address outputted from an address counter;

setting means for setting said recording head to be scanned in a forward or backward direction;

drive control means for controlling the driving and scanning of said recording head according to the direction set by said setting means;

a first register unit for setting a starting address into said address counter of said transferring means to adjust a print start dot position in response to the direction set by said setting means immediately before at least one of a forward or backward printing start time, the starting address indicating an address in the non-print region; and a second register unit for setting into said drive control means an initial value to adjust print start timing relating to a scanning position of said recording head in response to the direction set by said setting means immediately before at least one of a forward or backward printing start time.

25. A serial printer as claimed in claim 24 being applied to a copying machine.

26. A serial printer as claimed in claim 24 being applied to a facsimile.

27. A serial printer as claimed in claim 24 being applied to a data processor.

28. A serial printer as claimed in claim 24, further comprising transferring means for transferring a recording medium.

29. A serial printer as claimed in claim 24, further comprising recovery means for recovering said recording head.

30. A serial printer comprising:

recording head means for recording an image in a dot matrix;

scanning means for scanning said recording head;

driving means for driving said recording head; and a printer controller comprising:

an addressable buffer memory for storing print data, said addressable buffer memory including a print region capable of storing the print data and a non-print region having a space data corresponding to predetermined dots, wherein the print region corresponds to a recording region of one line on a recording medium, and wherein the non-print region in said addressable buffer memory is allocated on an address preceding the print region;

transferring means for transferring the print data from said addressable buffer memory to said recording head according to an address outputted from an address counter;

setting means for setting said recording head to be scanned in a forward or backward direction;

drive control means for controlling the driving and scanning of said recording head according to the direction set by said setting means; and a register unit for setting a starting address into said address counter of said transferring means due to adjust a print start dot position in response to the direction set by said setting means immediately before at least one of a forward or backward printing start time, the starting address indicating an address in the non-print region.

31. A serial printer as claimed in claim 30 being applied to a copying machine.

32. A serial printer as claimed in claim 30 being applied to a facsimile.

33. A serial printer as claimed in claim 30 being applied to a data processor.

34. A serial printer as claimed in claim 30, further comprising transferring means for transferring a recording medium.

35. A serial printer as claimed in claim 30, further comprising recovery means for recovering said recording head.

* * * * *

UNITED STATES PATENT AND TRADEMARK OFFICE

CERTIFICATE OF CORRECTION

PATENT NO. : 5,454,651

DATED : October 3, 1995

INVENTOR(S) : JIRO TATEYAMA

It is certified that error appears in the above-indentified patent and that said Letters Patent is hereby corrected as shown below:

COLUMN 9

Line 22, "denotes" should read --denote--; and
Line 24, "respectively," should read --respectively.--.

COLUMN 10

Line 30, "use" should read --use as--.

COLUMN 11

Line 38, "Also" should read --Also,--.

COLUMN 12

Line 17, "$OF," should read --$0F,--.

UNITED STATES PATENT AND TRADEMARK OFFICE

CERTIFICATE OF CORRECTION

PATENT NO. : 5,454,651 Page 2 of 2

DATED : October 3, 1995

INVENTOR(S) : JIRO TATEYAMA

It is certified that error appears in the above-indentified patent and that said Letters Patent is hereby corrected as shown below:

COLUMN 14

Line 23, "(to - t1)" should read --(t0 - t1)--;
Line 29, "over shooting" should read --overshooting--; and
Line 34, "speed" (second occurrence) should be deleted.

Signed and Sealed this

Fifth Day of March, 1996

*Attest:*

Bruce Lehman

BRUCE LEHMAN

*Attesting Officer*

*Commissioner of Patents and Trademarks*